US008646124B2

(12) United States Patent
Stryker et al.

(10) Patent No.: US 8,646,124 B2
(45) **Date of Patent: *Feb. 11, 2014**

(54) TRANSPORT APPARATUS

(75) Inventors: Martin W. Stryker, Kalamazoo, MI (US); Jeffrey L. Lewandowski, Delton, MI (US); Jason James Wroblewski, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 636 days.

This patent is subject to a terminal disclaimer.

(21) Appl. No.: 12/774,365

(22) Filed: May 5, 2010

(65) Prior Publication Data

US 2010/0287698 A1 Nov. 18, 2010

Related U.S. Application Data

(60) Provisional application No. 61/177,809, filed on May 13, 2009.

(51) Int. Cl.
*A61G 7/10* (2006.01)

(52) U.S. Cl.
USPC ..... 5/87.1; 5/86.1; 5/81.1 R

(58) Field of Classification Search
USPC ..... 5/81.1 R, 81.1 T, 83.1, 86.1, 87.1, 88.1, 5/620, 662
See application file for complete search history.

(56) References Cited

U.S. PATENT DOCUMENTS 1,923,617 A * 8/1933 Edensword ..... 297/183.6
2,498,853 A 2/1950 Hassold et al.
2,710,975 A 6/1955 Stoen et al.
2,733,452 A 2/1956 Tanney
2,761,153 A 9/1956 Mew
2,835,902 A * 5/1958 Fash ..... 5/627
2,903,238 A * 9/1959 Flandrick ..... 254/124
(Continued)

FOREIGN PATENT DOCUMENTS

FR 1512074 12/1967
GB 2404578 9/2005
(Continued)

OTHER PUBLICATIONS

PCT International Search Report dated Jan. 28, 2011 for corresponding PCT Application No. PCT/US2010/033727.

*Primary Examiner* — William Kelleher
*Assistant Examiner* — Myles Throop
(74) *Attorney, Agent, or Firm* — Warner Norcross & Judd LLP

(57) ABSTRACT

A transport apparatus includes a movable base, a sling, and a support frame mounted to the base. The frame extends over the base and is configured to move from a position spaced above the base at a first height wherein the frame may be extended over and proximate a support surface for engaging the sling when placed on the surface to another position spaced at a height greater than the first height after engagement with the sling. The sling is adapted to be engaged by the frame, which provides lateral support to the sling, wherein when the frame and sling are raised to the greater height the sling is raised above the surface so that a person supported on the sling may be lifted off the surface with the sling and the frame and supported in a stabilized sitting position so that the person can moved away from the surface.

15 Claims, 27 Drawing Sheets

(56) References Cited

U.S. PATENT DOCUMENTS

| | | | | | |
|---|---|---|---|---|---|
| 2,959,792 | A | | 11/1960 | Haugard | |
| 3,041,636 | A | | 7/1962 | Twedt | |
| 3,138,805 | A | | 6/1964 | Piazza | |
| 3,189,345 | A | * | 6/1965 | Simpson | 482/67 |
| 3,317,928 | A | | 5/1967 | Root | |
| 3,623,169 | A | | 11/1971 | James | |
| 3,790,974 | A | | 2/1974 | Johansson | |
| 3,940,808 | A | * | 3/1976 | Petrini | 5/83.1 |
| 3,999,227 | A | * | 12/1976 | Ingemansson | 5/83.1 |
| 4,011,609 | A | | 3/1977 | Bethlen | |
| 4,157,593 | A | | 6/1979 | Kristensson | |
| 4,194,253 | A | | 3/1980 | Ullven | |
| 4,195,375 | A | | 4/1980 | Paul | |
| 4,327,453 | A | | 5/1982 | Sefton | |
| 4,627,119 | A | | 12/1986 | Hachey et al. | |
| 4,644,595 | A | | 2/1987 | Daniel | |
| 4,726,082 | A | | 2/1988 | Dimatteo et al. | |
| 4,747,170 | A | | 5/1988 | Knouse | |
| 4,776,047 | A | | 10/1988 | DiMatteo | |
| 4,796,313 | A | | 1/1989 | Dimatteo et al. | |
| 4,821,352 | A | | 4/1989 | Dimatteo et al. | |
| 4,837,872 | A | | 6/1989 | Dimatteo et al. | |
| 4,868,938 | A | | 9/1989 | Knouse | |
| 4,987,620 | A | | 1/1991 | Sharon | |
| 5,020,171 | A | | 6/1991 | Dimatteo et al. | |
| 5,072,840 | A | | 12/1991 | Asakawa et al. | |
| 5,112,076 | A | * | 5/1992 | Wilson | 280/657 |
| 5,127,113 | A | | 7/1992 | Dimatteo et al. | |
| 5,155,874 | A | | 10/1992 | Kershaw | |
| 5,189,741 | A | | 3/1993 | Beardmore | |
| 5,201,377 | A | | 4/1993 | Wilson | |
| 5,255,934 | A | * | 10/1993 | Wilson | 280/657 |
| 5,319,813 | A | | 6/1994 | Dimatteo et al. | |
| 5,379,468 | A | | 1/1995 | Cassidy et al. | |
| 5,380,034 | A | | 1/1995 | Wilson | |
| 5,423,562 | A | * | 6/1995 | Pearce, Jr. | 280/250.1 |
| 5,489,258 | A | | 2/1996 | Wohnsen et al. | |
| 5,539,941 | A | | 7/1996 | Fuller | |
| 5,544,371 | A | | 8/1996 | Fuller | |
| 5,555,582 | A | | 9/1996 | Jerideau | |
| 5,697,109 | A | | 12/1997 | Hodgetts | |
| 5,704,439 | A | * | 1/1998 | Kitahama et al. | 180/65.1 |
| 5,819,339 | A | | 10/1998 | Hodgetts | |
| D402,434 | S | | 12/1998 | Votel | |
| 5,890,238 | A | | 4/1999 | Votel | |
| 6,092,247 | A | * | 7/2000 | Wilson | 5/86.1 |
| 6,119,287 | A | * | 9/2000 | Phillips | 5/81.1 RP |
| 6,341,393 | B1 | | 1/2002 | Votel | |
| 6,363,555 | B1 | | 4/2002 | LaRose | |
| 6,378,148 | B1 | | 4/2002 | Votel | |
| 6,430,761 | B1 | * | 8/2002 | Brandorff et al. | 5/86.1 |
| 6,457,700 | B1 | * | 10/2002 | Hong | 254/8 B |
| 6,507,963 | B2 | | 1/2003 | Hodgetts | |
| 6,532,610 | B1 | * | 3/2003 | Calfas et al. | 5/626 |
| 6,591,435 | B1 | | 7/2003 | Hodgetts | |
| 6,701,546 | B2 | | 3/2004 | Hodgetts | |
| 6,823,541 | B2 | | 11/2004 | Egan | |
| 6,857,144 | B1 | | 2/2005 | Huang | |
| 6,886,194 | B2 | | 5/2005 | Hodgetts | |
| 6,934,980 | B2 | | 8/2005 | Harney | |
| 6,938,285 | B2 | | 9/2005 | Fernie et al. | |
| 6,964,070 | B2 | | 11/2005 | Hawk et al. | |
| 7,003,820 | B1 | | 2/2006 | Iura et al. | |
| 7,040,641 | B2 | | 5/2006 | Wing | |
| 7,114,203 | B2 | | 10/2006 | Lloyd et al. | |
| 7,340,784 | B2 | | 3/2008 | Stryker et al. | |
| 7,424,756 | B2 | | 9/2008 | Van Raemdonck | |
| 7,434,278 | B2 | | 10/2008 | White et al. | |
| 7,480,949 | B2 | | 1/2009 | Bloomquist | |
| 7,591,030 | B2 | | 9/2009 | Stryker et al. | |
| 7,624,458 | B2 | * | 12/2009 | Felling | 5/81.1 T |
| 7,735,165 | B2 | | 6/2010 | Stryker et al. | |
| 2002/0069461 | A1 | * | 6/2002 | Egan | 5/81.1 R |
| 2004/0154097 | A1 | | 8/2004 | Blevins | |
| 2004/0163173 | A1 | | 8/2004 | Downing | |
| 2004/0221388 | A1 | | 11/2004 | Votel | |
| 2005/0039256 | A1 | | 2/2005 | Price et al. | |
| 2005/0193488 | A1 | | 9/2005 | Blevins | |
| 2007/0124859 | A1 | | 6/2007 | Stryker et al. | |
| 2012/0090089 | A1 | * | 4/2012 | Stryker et al. | 5/87.1 |

FOREIGN PATENT DOCUMENTS

| | | |
|---|---|---|
| JP | 2001346839 | 12/2001 |
| JP | 2002345899 | 12/2002 |
| JP | 2003079678 | 3/2003 |
| KR | 200177633 | 4/2000 |

* cited by examiner

TRANSPORT APPARATUS

CROSS-REFERENCE TO RELATED APPLICATION

This application claims the benefit of and priority from U.S. provisional patent application Ser. No. 61/177,809, filed May 13, 2009, entitled TRANSPORT APPARATUS, by Applicant Martin W. Stryker, which is incorporated by reference herein in its entirety.

TECHNICAL FIELD AND BACKGROUND OF THE INVENTION

The present invention generally relates to a transport apparatus for moving a person, such as a patient, from one location to another location, for example from a bed to a wheelchair.

When a caregiver assists an immobile person move or transfer, for example, from a bed to a wheel chair, whether the lack of mobility is due to illness or a disability, the caregiver is exposed to strain and stress that could potentially harm the caregiver. In an effort to reduce the strain and stress on caregivers, numerous devices have been developed that reduce the force need to move the patient across the surface on which the person is supported and typically are designed to move a person when in a supine position. But most of these devices have fallen short of reducing the strain and stress when moving a person when they are to be moved from a supine position on one surface to a sitting position on another surface or moved from a sitting position on one surface to a sitting position on another surface.

Further, most of these devices are designed to assist a caregiver and do not enable the person to become more mobile themselves, and hence force reliance on a caregiver.

SUMMARY OF THE INVENTION

Accordingly, the present invention provides a transport apparatus that allows a person to be moved from a supine position or a sitting position on one surface, such a bed or seat, to a sitting position or supine position on another surface, such as a seat or bed, while reducing the stress or strain on the caregiver moving the person. Further, the transport apparatus may enable an otherwise less mobile person to move themselves.

In one form of the invention, a transport apparatus includes a base, a sling, and a support frame mounted to the base. The support frame extends over the base and is configured to move from a first position spaced above the base at a first height wherein the support frame may be extended over and proximate a support surface for engaging the sling when placed on the support surface to a second position spaced above a second height greater than the first height after engagement with the sling. The sling is adapted to be engaged by the support frame, which provides lateral support to the sling, wherein when the support frame and sling are raised to the second position the sling is raised above the support surface so that a person supported on the sling may be lifted off the support surface with the sling and frame and supported in a stabilized sitting position so that the person can moved away from the support surface by the base.

In one aspect, the base is mounted to a floor, a wall or to a bed.

According to another aspect, the base includes a plurality of bearings. Further, one set of the bearings may comprise a pair of wheels, which are sized to permit a person when supported by the sling and the support frame to engage the wheels to thereby move the base. Further, the wheels may be movable from a stowed position to an operative position where the wheels can engage the ground and move the transport apparatus.

In another aspect, the sling includes an opening to allow a user to use a commode without the removal of the sling. Further, the sling may be disposable.

According to yet other aspects, the sling includes a seat portion and a back portion. The seat portion and back portion are connected together and are reconfigurable between an unfolded, generally planar configuration wherein the sling can lie generally flat on a support surface so that a person may be moved onto the sling and a folded configuration wherein a person can be supported in a sitting position on the sling. Further, the support frame is engageable with the seat portion for engaging the sling and also engageable with the back portion so that when engaged with the back portion, the support frame retains the sling in its folded configuration.

In a further aspect, the support frame includes a pair of arms, with the seat portion including a pair of sleeves for receiving the arms. Further, the back portion may include couplers to provide engagement between the back portion and the support frame, for example, after the arms of the support frame are received into the sleeves and the sling is in its folded configuration.

According to yet another aspect, the base includes a plurality of bearings. The bearings define a footprint, with the support frame mounted to the base outside of the foot print.

In yet another aspect, the transport apparatus further includes an upstanding support mounted to the base and a four bar linkage mounted at its proximal end to the upstanding support, with the support frame mounted to the distal end of the four bar linkage. Further, the transport apparatus may include two four bar linkages, with each of the proximal ends of the four bar linkages being pivotally mounted to the upstanding support. The support frame is then mounted to the distal ends of the four bar linkages. In addition, the four bar linkages may be interconnected by a transverse member, which is then engaged by a driver supported on the base to thereby pivot the four bar linkages about their proximal ends, and thereby raise or lower the support frame.

According to yet a further aspect, the support frame is further configured to move to a third position at a third height different than the first height and the second height wherein a person supported on the sling may be deposited on a second support surface at a lower or greater height than the first support surface.

In another form of the invention, a transport apparatus includes a movable base, a sling, and a support frame mounted to the base. The sling has a seat portion reconfigurable between a generally planar configuration wherein the sling can lie generally flat on a support surface and a cradle configuration wherein a person can be supported in a sitting position in the sling. The frame is configured to move from a first position spaced above the base at a first height wherein the support frame may be extended over and proximate a support surface to a second position spaced above the base at a second height greater than the first height. The frame is engageable with the seat portion for engaging the sling when the sling is in its generally planar configuration and the frame is in the first position. In this manner, the transport apparatus can support and transport a person supported by the sling from one location to another location. In addition, the sling is optionally releasably engaged with the frame wherein a person supported by the sling and the support frame may be then deposited together with the sling on another support surface when the frame is extended over the other support surface.

According to one aspect, the transport apparatus further includes a driver supported on the base, which is operable by a user or a person supported by the transport apparatus. The driver may be used to move the support frame between its first and second positions. Alternately, the driver is provided to move the transport apparatus across a support surface.

In yet another aspect, the seat portion includes a pair of sleeves, with the frame having a pair of arms, which are extendable into the sleeves to thereby releasably engage the sling.

In another aspect, the sling additionally includes a back portion with the seat portion and back portion being connected together and being reconfigurable between an unfolded, generally planar configuration wherein the sling can lie generally flat on a support surface and a folded configuration wherein a person can be supported in a sitting position in the sling with the person's back supported by the back portion.

In a further aspect, the frame is selectively engageable with the back portion wherein when so engaged with the back portion the support frame retains the sling in its folded configuration.

According to yet another aspect, the base includes a plurality of bearings. Further, one set of the bearings may comprise a pair of wheels, which are sized to permit a person when supported by the sling and the support frame to engage the wheels to move the base. Further, the wheels may be movable from a stowed position to an operative position where the wheels can be used to transport a person carried by the transport apparatus.

According to yet another embodiment, a transport apparatus includes a movable base, a support frame mounted to the base, and a footrest supported by the support frame. The frame is configured to move from a first position spaced above the base at a first height to a second position spaced above the base at a second height greater than the first height. The apparatus also includes a driver supported by the base, which is operative to raise or lower the support frame to thereby raise or lower the footrest.

Accordingly, the present invention provides a transport apparatus that facilitates a person moving themselves, or being moved by another person, from one support surface to another support surface or simply to allow the person to be transported from one location to another location without burdening a caregiver with the job of lifting the person.

These and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENT

Figure 1:
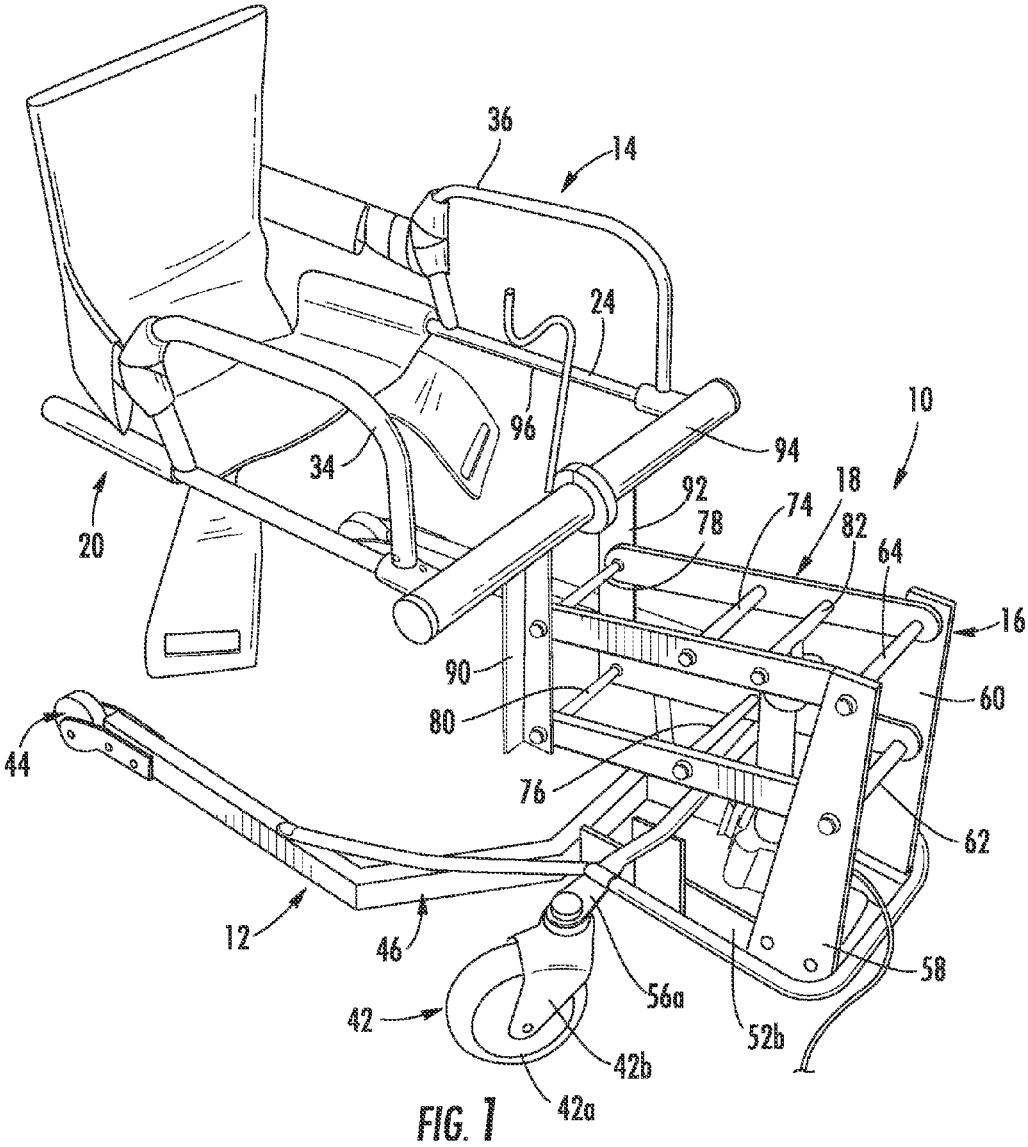
FIG. 1 is a perspective view of a transport apparatus of the present invention.
Figure 2:
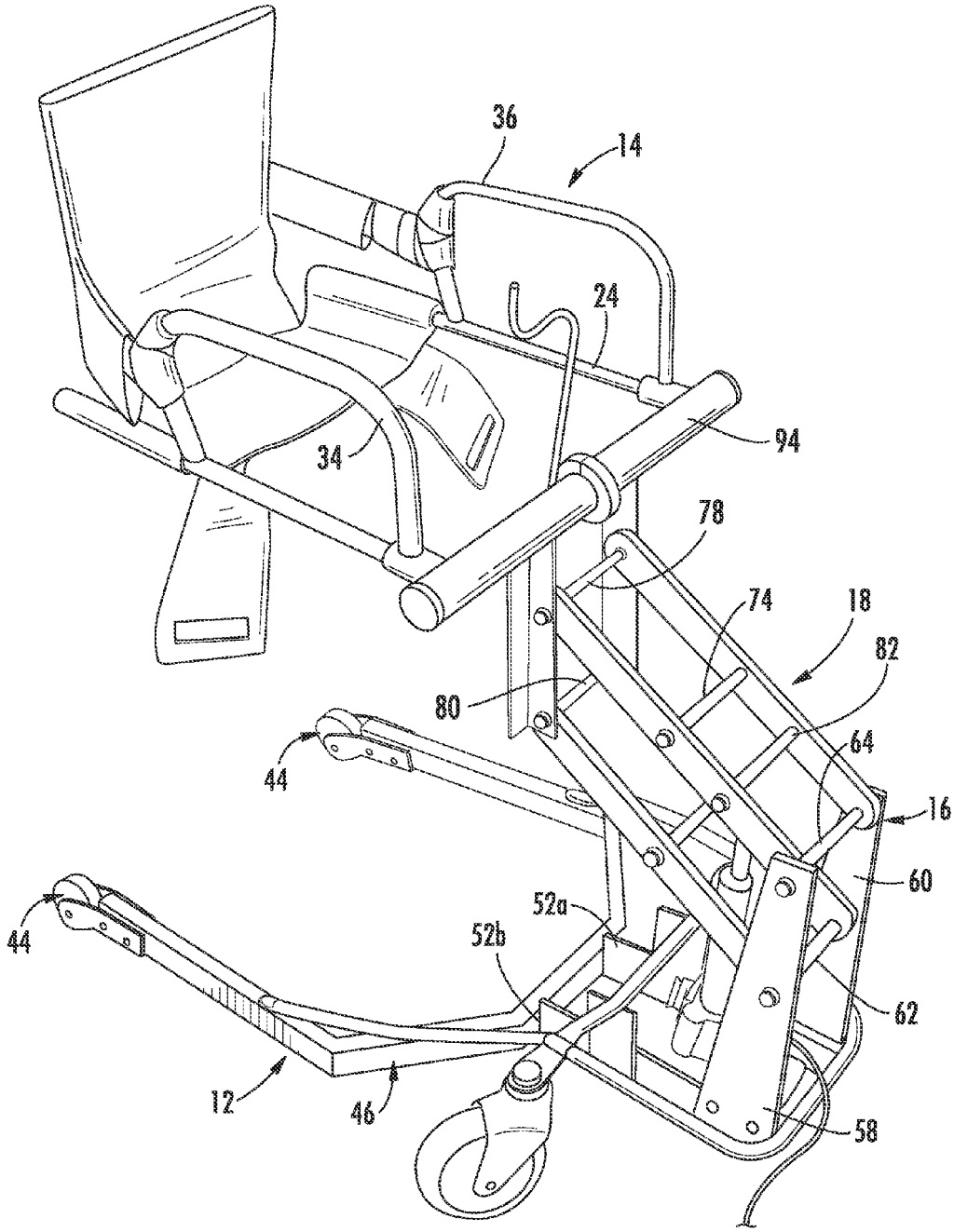
FIG. 2 is a similar view to FIG. 1 illustrating a support frame and a sling of the transport apparatus of FIG. 1 moved to a raised position.

Referring to FIG. 1, the numeral 10 generally designates a transport apparatus of the present invention. As will be more full described below, transport apparatus 10 allows a person to be transferred or moved from a supine position or a sitting position on one surface, such a bed or seat, to a sitting position or supine position on another surface, such as a seat or bed, while reducing the stress or strain on the caregiver moving the person. Further, as described in reference to one embodiment, the transport apparatus may enable the person to move themselves. It should be understood that the term "transport" is used broadly to mean a transfer from one location to another location; therefore, the reference to a transport apparatus includes apparatus that allow a person to be moved from one location or position to another location or position.

As best seen in FIG. 1, transport apparatus 10 includes a base 12 and a support frame 14, which is movably mounted to base 12 by an upright support 16 and a four bar linkage assembly 18. Transport apparatus 10 further includes a sling 20, which is removably mounted to frame 14 and, further, may be configured between a generally planar arrangement in which the sling may be laid generally flat on a support surface, such as a bed B, or reconfigured into a folded configuration such as shown in FIG. 1 to support a person in a sitting position, described more fully below.

Figure 5:
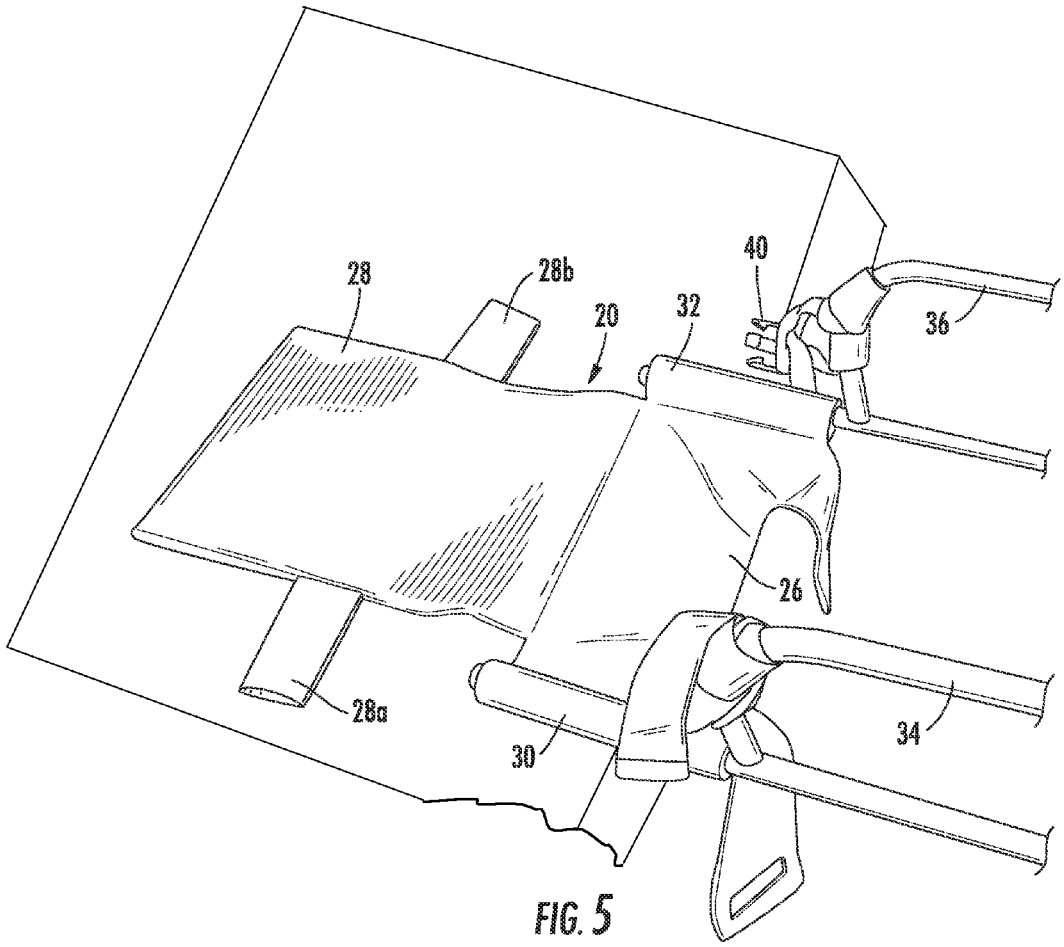
FIG. 5 illustrates the sling of the transport apparatus with the back portion of the sling released from engagement with the frame of the transport apparatus so that the sling lies generally flat on the support surface.
Figure 6:
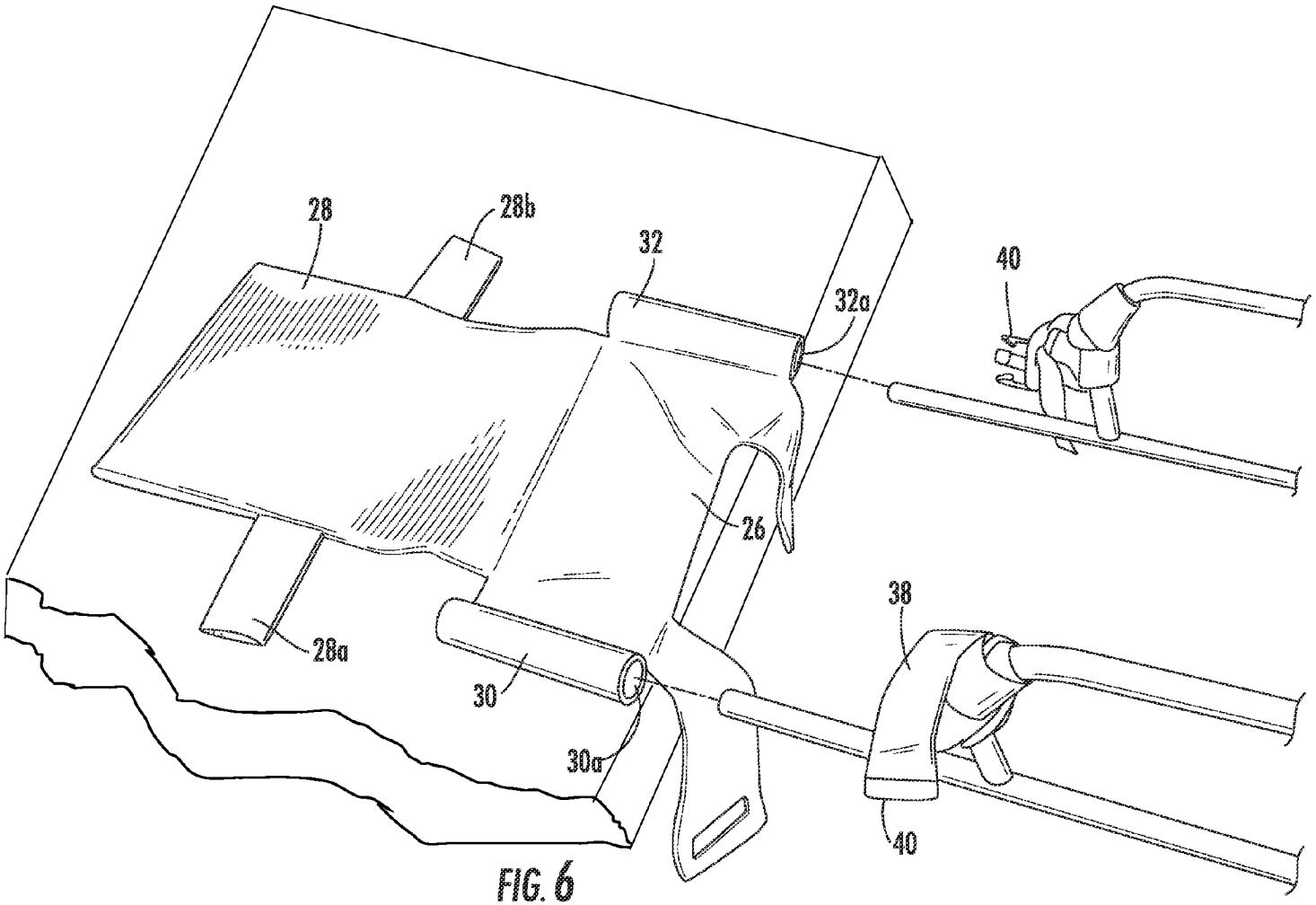
FIG. 6 is a similar view to FIG. 5 illustrating the frame of the transport apparatus disengaged from the seat portion of the sling.

Referring to FIGS. 1-7, sling 20 is releasably mounted to frame 14 on a pair of spaced apart generally horizontal arms 22 and 24 of frame 14. In the illustrated embodiment, frame 14 is formed from round tubular metal members, which are welded together to form a rigid frame with arms 22 and 24 cantilevered from a cross-frame member 25. As best seen in FIGS. 5 and 6, sling 20 includes a seat portion 26 and a back portion 28, which are formed from two panels of material which are connected together, for example, by stitching or the like, and may be reconfigured from a generally planar arrangement such as shown in FIG. 6 to a folded position such as shown in FIG. 1 to thereby support a person in a sitting position. Though it should be understood that the sling may be formed from a single panel, as well, or multiple panels. The panels may be formed from a flexible material, such as a fabric, including a breathable or gas permeable fabric to provide enhanced air circulation to the person supported by sling 20. For example, a suitable fabric may include Gortex or the like.

Referring again to FIGS. 5 and 6, seat portion 26 of sling 20 includes a pair of sleeves 30 and 32 formed at the opposed sides of seat portion 26, which are spaced apart generally at the same spacing as arms 22 and 24 to allow arms 22 and 24 of frame 14 to extend into the respective sleeves 30, 32 to thereby engage the sling. Optionally sleeves 30 and 32 may include tubular inserts 30*a* and 32*a* (FIG. 6), such as plastic tubes, to maintain sleeves 34 and 32 open and further to provide a low friction surface to ease the insertion of arms 22 and 24 into the respective sleeves. In this manner, when sling 20 is mounted to arms 22 and 24, seat portion 26 of sling 20 is extended between arms 22 and 24 and further back portion 28 faces inwardly toward cross-frame member 25. Therefore, when a person is seated in sling 20, the weight of the patient will generate lateral reactions forces at arms 22 and 24, which will tension seat portion 26 between the arms and provide stability to the sling and patient seated in sling 20. As a result, the patient will not feel significant lateral or side to side motion when seated in sling 20. In addition, because the arms provide fairly uniform support to the seat portion along its sides substantially over the full depth of the seat portion, a person seated in sling 20 will not experience any significant, if at all, forward or aft rocking motion.

Frame 14 additionally includes a pair of inverted generally U-shaped handles 34 and 36, which are mounted, such as by welds, to arms 22 and 24 and provide support for back portion 28. Handles 34 and 36 may also be formed from metal tubes. In the illustrated embodiment, back portion 28 is secured to handles 34 and 36 by straps 38 and couplers 40, such as buckles, which couple to outwardly projecting extensions or arms 28*a* and 28*b* of back portion 28, which may for example include corresponding, structures, such as receptacles, for receiving the couplers or buckles. In this manner, once seat portion 26 is mounted on arms 22 and 24, back portion 28 may be folded and then secured to handles 34 and 36. Handles 34 and 36 also provide hand holds for a person supported in sling 20.

Therefore, in operation, when a person is lying on bed B, and a transfer of the person is desired, the harness may be positioned under the person. If the person is not in a seated position, the person must then be repositioned so that the person is sitting on the seat portion 26 of sling 20 and further with the person's legs hanging over the side of the bed. Once the person is in this position, arms 22 and 24 of transport apparatus 10 may be moved and extended into sleeves 30 and 32. Once sufficiently extended in sleeves 30 and 32, back portion 28 may be lifted behind the person to allow the back portion to be coupled to frame 14 at handles 34 and 36 and thereby provide support to the person's back. Thereafter, frame 14 may be raised to thereby lift the person off the bed to allow the person to be transferred from the bed, as previously noted, to another location or to another support surface. It should be understood for a person who has some upper body mobility, that the person may place themselves on the sling and maneuver themselves into position and further position the support frame to engage the sling so that the person may use apparatus 10 to moves themselves off, for example, a bed, as will more fully described below.

Referring again to FIG. 1, in the illustrated embodiment, base 12 comprises a movable base with a forward set of bearings 42 and a rearward set of bearings 44. In the illustrated embodiment, bearings 42 comprise wheels 42*a*, which are rotatably mounted to base frame 46 about a vertical axis as well as a horizontal axis by yokes 42*b* to provide steering. Bearings 44 may also comprise wheels 44*a* that are mounted about a fixed rotational axes at the rear most end of frame 46 and, further, which have a low profile so that frame 46 and wheels 44*a* may be extended under a bed or other support surface or apparatus, such as table, desk or under a vehicle body. Alternately, the bearings may comprise casters, low friction pads or skids, air bearings, or the like or a combination of different types of bearings. An example of a suitable low profile bearing is described in U.S. Pat. No. 7,441,786, entitled CONVERTIBLE LOW PROFILE ROLLER AND SUPPORT BASE, issued Oct. 28, 2008, which is commonly owned by Stryker Corporation of Kalamazoo, Mich. and incorporated by reference herein in its entirety.

Figure 3:
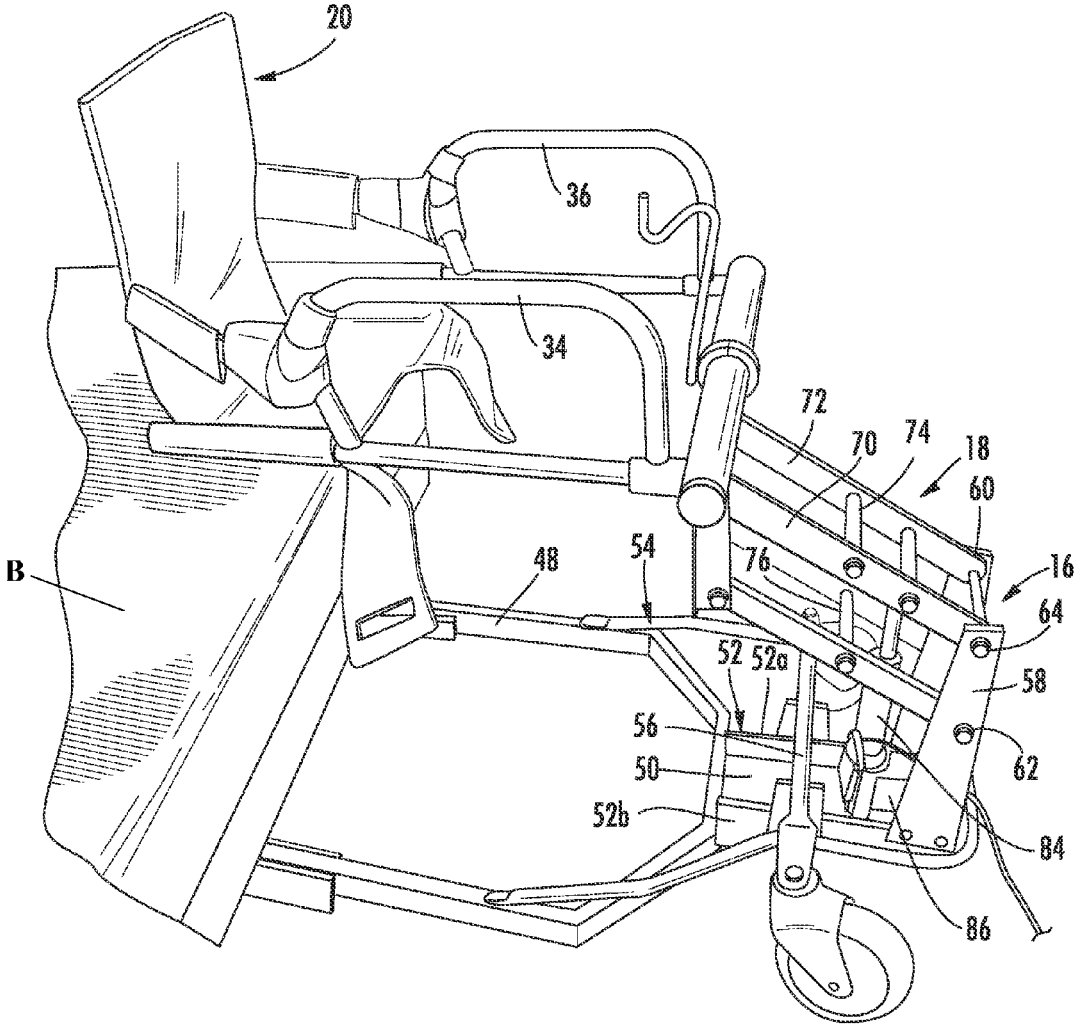
FIG. 3 is a similar view to FIG. 2 illustrating the transport apparatus positioning the frame and the sling over a support surface.
Figure 4:
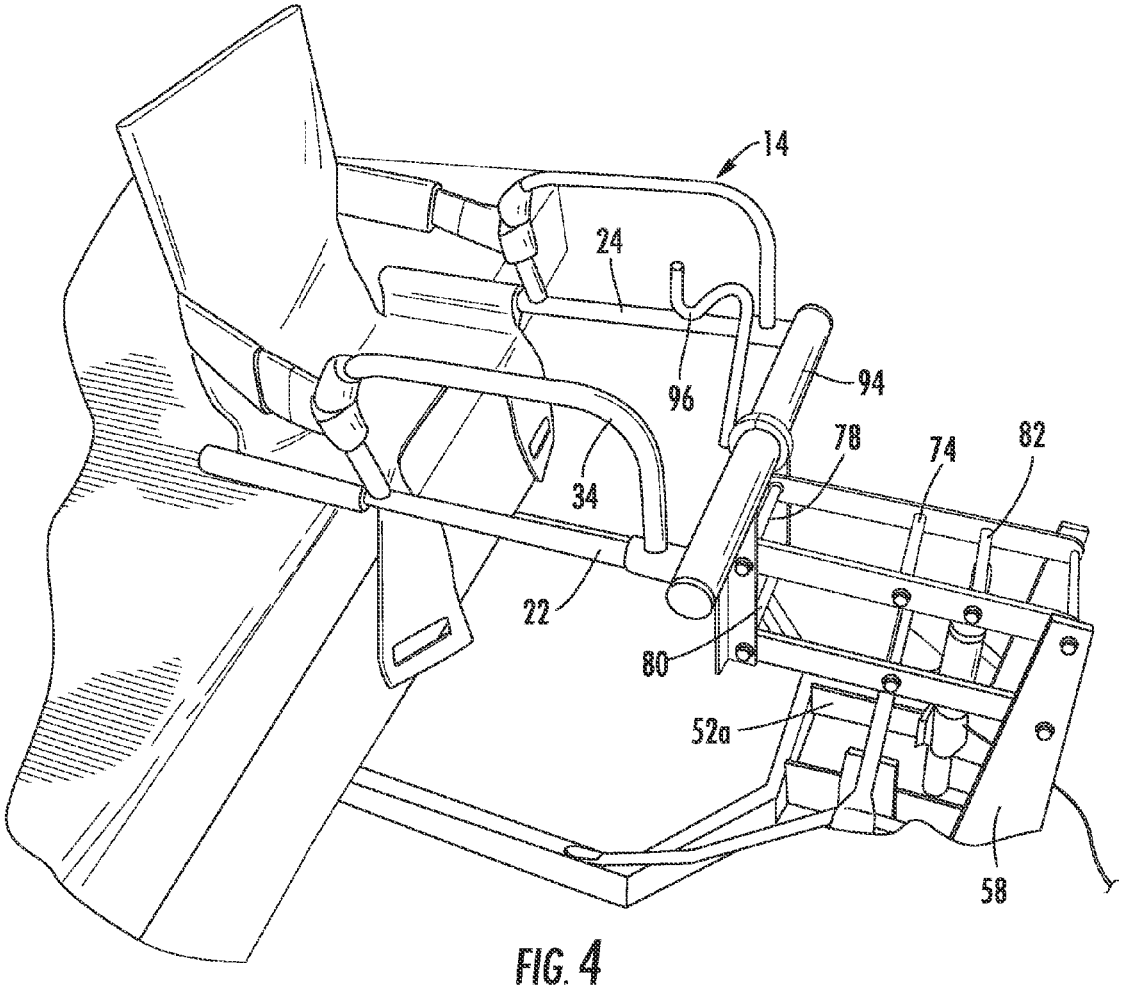
FIG. 4 is similar to FIG. 3 illustrating the frame and the sling of the transport apparatus of FIG. 3 lowered so that the frame and the sling are extended over and proximate the support surface.

As best seen in FIG. 3, frame 46 includes a generally U-shaped frame member 48 and a forward (as viewed from a person seated in sling 20) projecting base, such as a base plate 50 formed by an inverted channel-shape member 52, which provides a mounting surface for support 16 and also a driver, more fully described below. It should be understood that other structural members may be used. Mounted to frame member 48 over and around base plate 50 is a second U-shaped frame member 54 with a transverse frame member 56, which provides a mounting surface for forward wheels 42*a*. As best seen in FIG. 1, wheels 42*a* are mounted to the couplers 56*a*, which connect transverse frame member 56 to U-shaped frame member 54, by yokes 42*a*, which as noted provide a swivel connection for wheels 42*a*.

As noted, channel member 52 supports upright support 16, which mounts frame 14 to base 12. In the illustrated embodiment, support 16 comprises a pair of spaced apart trapezoidal-shaped plates 58 and 60, which are secured at their proximal end to upwardly facing flanges 52*a* and 52*b* of channel-shaped member 52, for example, by fasteners or welds. Mounted between plate members 58 and 60 is four bar linkage assembly 18. As best seen in FIGS. 1, 3, 4, and 7, four bar linkage assembly 18 includes two four bar linkages 70 and 72, which are pivotally mounted at their proximal ends to plate 58 and 60 by transverse rods 62 and 64. Further, four bar linkages 70 and 72 are interconnected by transverse rods 74 and 76 and transverse rods 78 and 80, which pivotally mount frame 14 to linkage assembly 18. Transverse members 74 and 76 provide reinforcement and are, therefore, optionally depending on the application. Alternately, four bar linkages 70 and 72 may include additional reinforcing transverse rods or members.

The upper bars 70*a* and 72*a* of four bar linkages 70 and 72 are also interconnected by an additional transverse rod 82, which provides an engagement structure for a driver 84, which is supported on plate 50 and used to pivot linkage assembly 18 about support 16. For example, a suitable driver includes an electric linear driver, such as a Linak® linear actuator, or a hydraulic cylinder. Driver 84 may be powered by a battery and/or pump and battery 86 also mounted to plate 50. As will be understood from FIGS. 1-4 and 7, when the output of the driver, which is coupled to transverse member 82, is extended, linkage assembly 18 pivots upwardly about support 16. Similarly, when the output is retracted, linkage assembly 18 lowers frame 14 relative to base 12. Optionally, a controller may be provided that has discrete positions or may provide an infinite number of positions to enhance the control over the position of sling 20. Further, apparatus 10 may include a user actuatable control, such as a button or buttons, mounted to frame 14 to allow driver 84 to be operated by the person being transported or by a caregiver. Alternately or in addition, a remote control device or pendant control may be used to operate driver 84. In addition, as will be more fully described below, transport apparatus 10 may be driven across a surface, for example, by a powered hub motor wheel or may be driven by the person. Further, as will be more fully described below, transport apparatus 10 may incorporate a footrest 88.

Referring again to FIGS. 1-4 and 7, frame 14 is mounted to the distal end linkage assembly 18 by a pair of mounting members, for example angle members 90 and 92, which are welded or otherwise connected to transverse member 25. In addition, to mounting frame 14 to vertical members 90 and 92, transverse member 25 may provide a mounting surface for a hook 96, for example, so that should a person need an IV while being transported, an IV bag may be suspended from hook 96. Alternately, or in addition, as described below, an IV pole mount or an IV pole may be mounted to the upright support or base.

Figure 7:
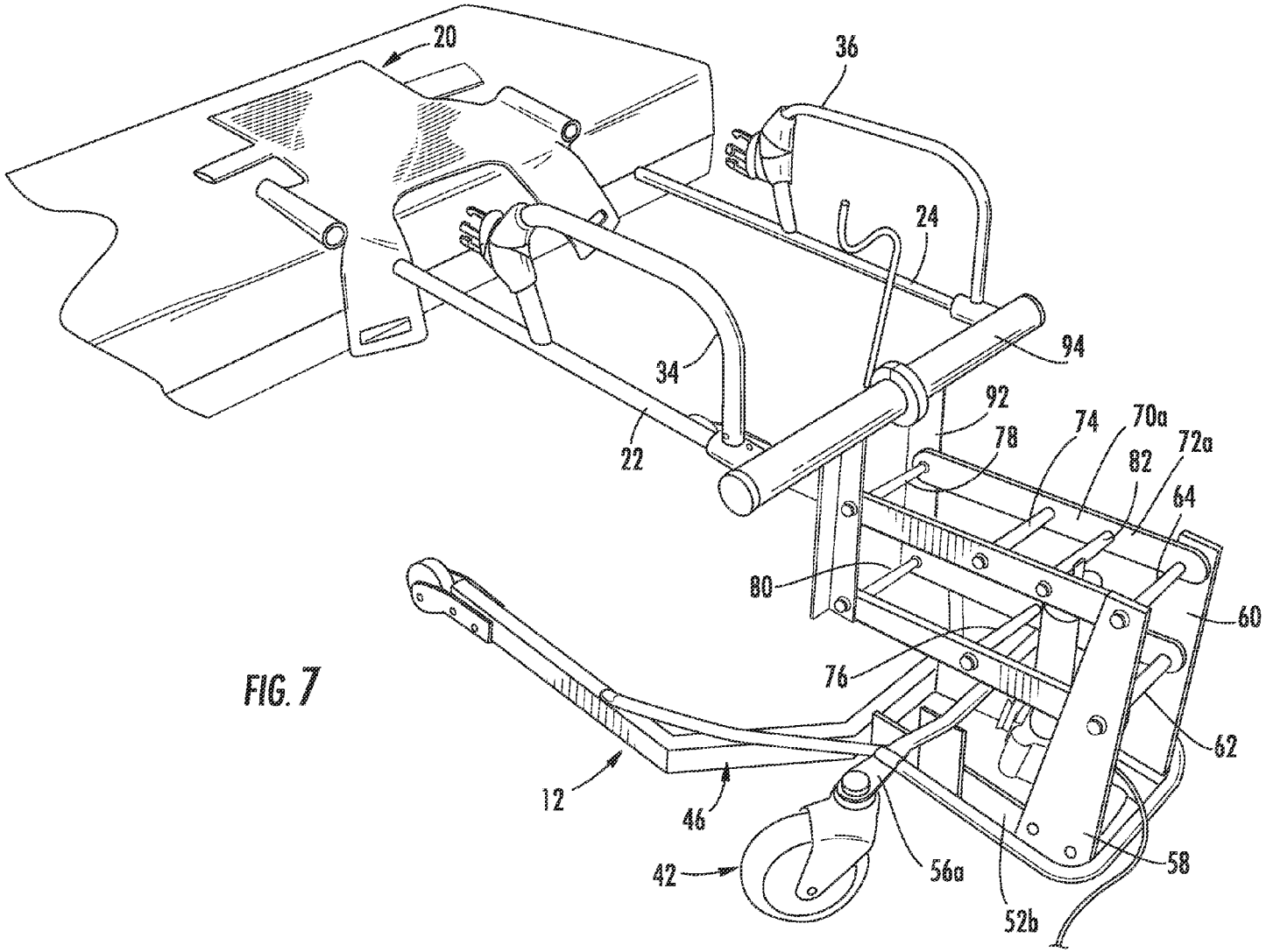
FIG. 7 is another perspective view of the transport apparatus disengaged from the sling.
Figure 7A:
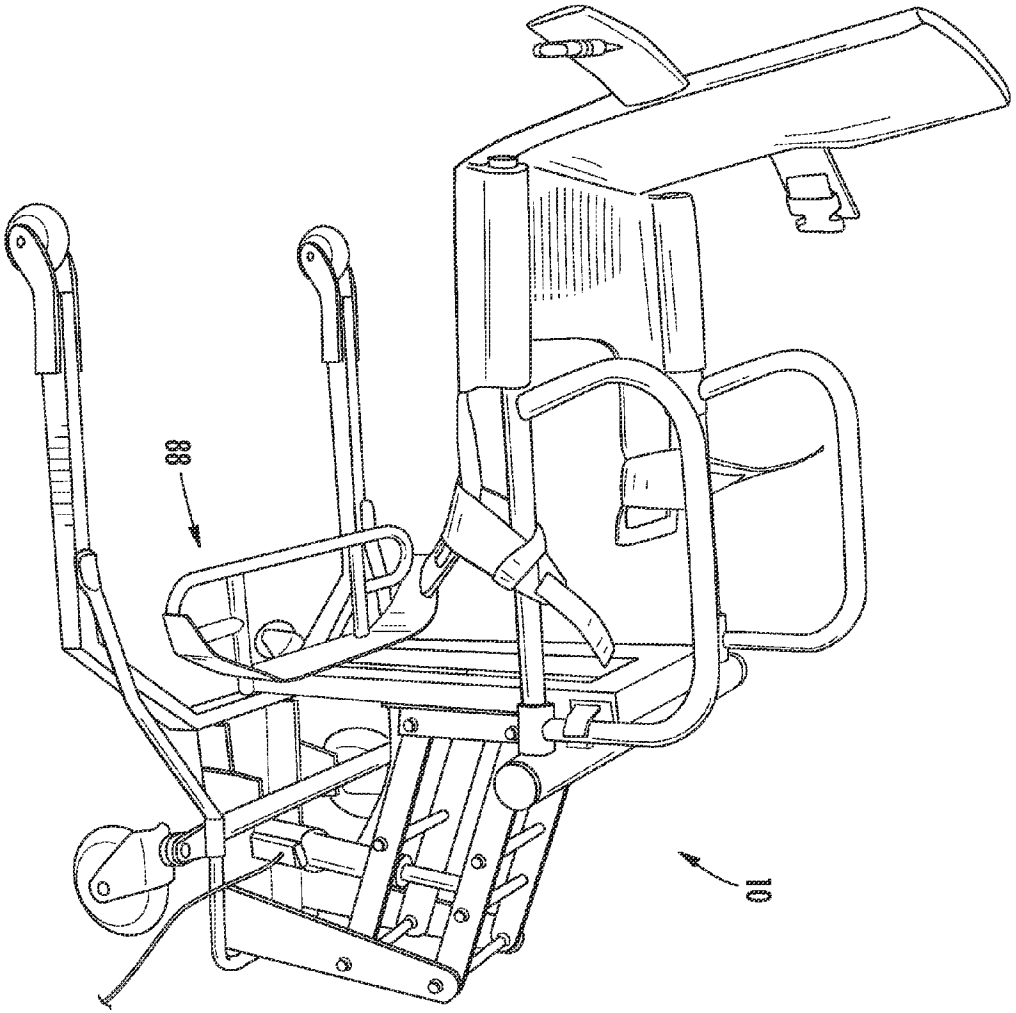
FIG. 7A is perspective view of the transport apparatus of FIG. 1 with a foot rest.
Figure 7B:
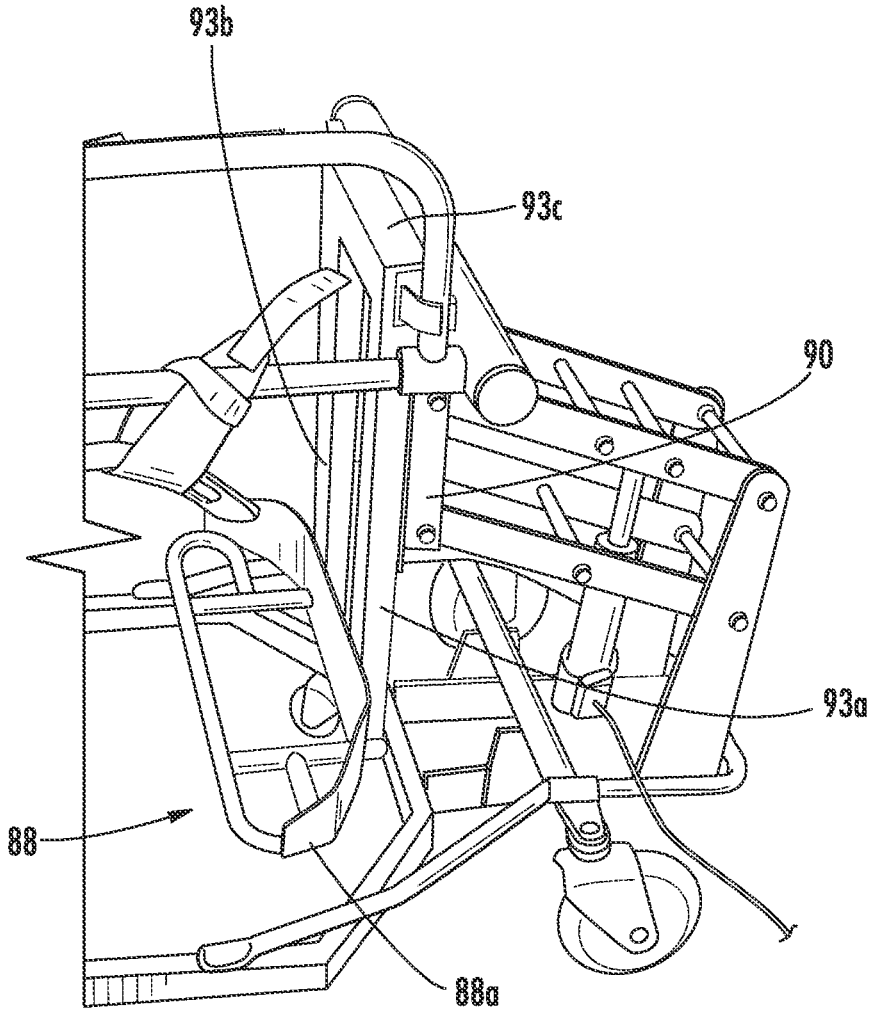
FIG. 7B is an enlarged view of the footrest and footrest mounding details of the transport apparatus of FIG. 7A.
Figure 7C:
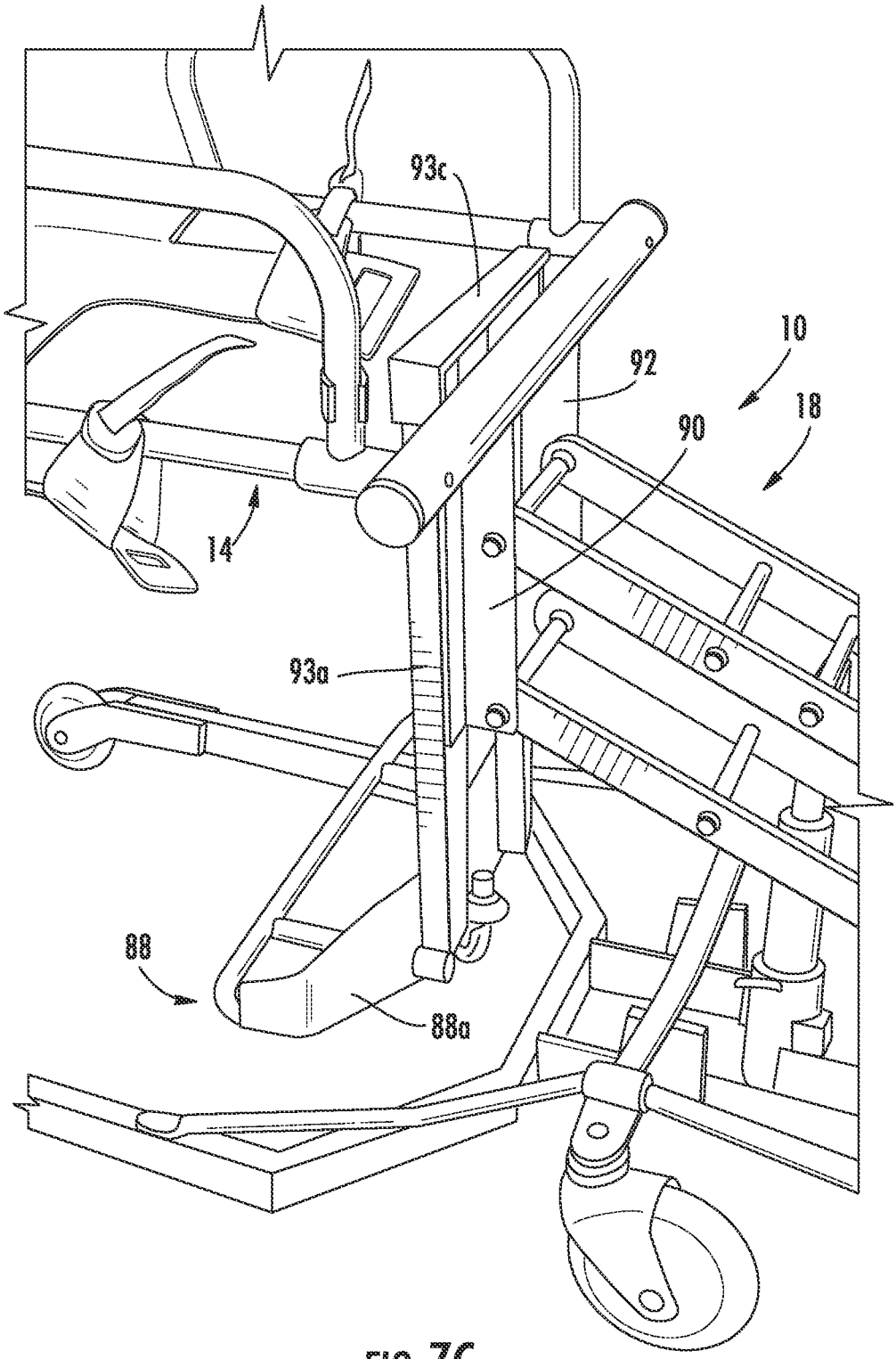
FIG. 7C is another enlarged view of the footrest and foot rest mounting details of FIG. 7B.

Referring to FIGS. 7A-7C, transport apparatus 10 may also incorporate a footrest 88. Footrest 88 allows a person who is being transported by apparatus 10 to reduce the pressure on the person's thighs and helps further stabilize the person. Footrest 88 may be fixed, for example, to members 90 and 92 by a bracket or may be movably mounted to members 90 and 92. In the illustrated embodiment, footrest 88 is movably mounted to members 90 and 92 so that the movement of frame 14 is not limited by the interference between footrest 88 and the ground.

As best seen in FIGS. 7B and 7C, footrest 88 is formed from a tubular frame that is mounted to vertical members 90 and 92 by channel members 93*a* and 93*b*. Footrest 88 is secured to channel members 93*a* and 93*b* at their respective lower ends by fasteners, such as bolts, which are supported for vertical movement relative to members 90 and 92 on a corresponding pair of slide rails that are mounted to members 90 and 92. It should be understood that footrest 88 may also be welded or attached to channels using other fastening methods. Suitable sliderails include conventional sliderails with nesting channel-shaped rails that are mounted together with ball bearings in bearing raceways formed, for example, in the flanges of the rails, such as are available from Knape and Vogt of Grand Rapids, Mich.

The upper ends of channel members 93*a* and 93*b* are interconnected by a transverse inverted channel member 93*c*, which may form a stop that abuts the top of the sliderails when footrest 88 is in its lowermost position or simply hold channels in spaced registry.

In this manner, when frame 14 is lowered and footrest 88 makes contact with the ground, frame 14 can continue to be lowered and channel members 93*a* and 93*b* will translate along members 90 and 92 to allow footrest 88 move upwardly. To maintain footrest in its lowermost position, springs are mounted in channel members 93*a* and 93*b* which bias channels 93*a* and 93*b*, and hence footrest 88, downwardly. The stiffness of the springs may be varied and are optionally selected to reduce the pinch force that can be exerted by the footrest on a person's foot should the person's foot or toes be beneath footrest 88 when frame 14 is lowered.

In addition, a latch or detent mechanism may be provided to allow the footrest to be releasably fixed in selected intermediate positions to accommodate people with different leg lengths, but still allow an upward force to disengage the mechanism so that the footrest may be raised when frame 14 is lowered.

Furthermore, the size of footrest 88 may be increased to allow footrest 88 to be used as a stand or to scoop up a patient. For example, not only can apparatus 10 be used to transfer a person, such as a patient, from one location to another location, apparatus 10 may be used as a transport apparatus that lifts a person from one vertical location to another vertical location. For example, a remote or a pendant control may be provided to allow, a person standing on footrest 88 to power driver 84 to raise footrest 88 or the driver may be actuated by a remote control.

As noted, footrest may also be used to scoop up a person. For example, when a person is in a seated position facing away from apparatus 10, footrest 88 may be positioned under the person's backside. An operator may then actuate driver 84, for example, using a control mounted to apparatus 10, including a pendent control that is tethered to apparatus 10, or a remote control, to raise frame 14 and lift the patient.

To protect the person's feet or back from being pinched when footrest 88 is raised, footrest 88 may also include a fence or wall 88*a*, which mounts to channel members 93*a* and 93, to form a barrier between the person's feet or back and the other components that form the frame and linkage assembly.

Referring to FIGS. 8, 8A, and 9-13 the numeral 110 generally designates another embodiment of the transport apparatus of the present invention. Similar to the previous embodiment, transport apparatus 110 includes a base 112 and a movable support frame 114, which permits a person to be transported in a sling 120 and, further, lifted from a support surface using sling 120 and then transferred to another support surface or simply transported to allow the person to engage in activities, such as reading or writing at a desk or to allow the person to use a commode, or to allow the person to be transported in or drive a vehicle.

Transport apparatus 110 similarly includes a generally upstanding support 116 and a four bar linkage assembly 118 that is pivotally mounted to support 116 and which supports frame 114 and sling 120 for vertical movement. In the illustrated embodiment, sling 120 similarly includes a seat portion 126 and a back support portion 128. However, in the illustrated embodiment, seat portion 126 has a generally U-shaped configuration to form an opening 126*a*, which allows the sling to be placed under the person while the person is in a seated position and, further, allows the person to use a commode without removal of the sling.

Figure 8:
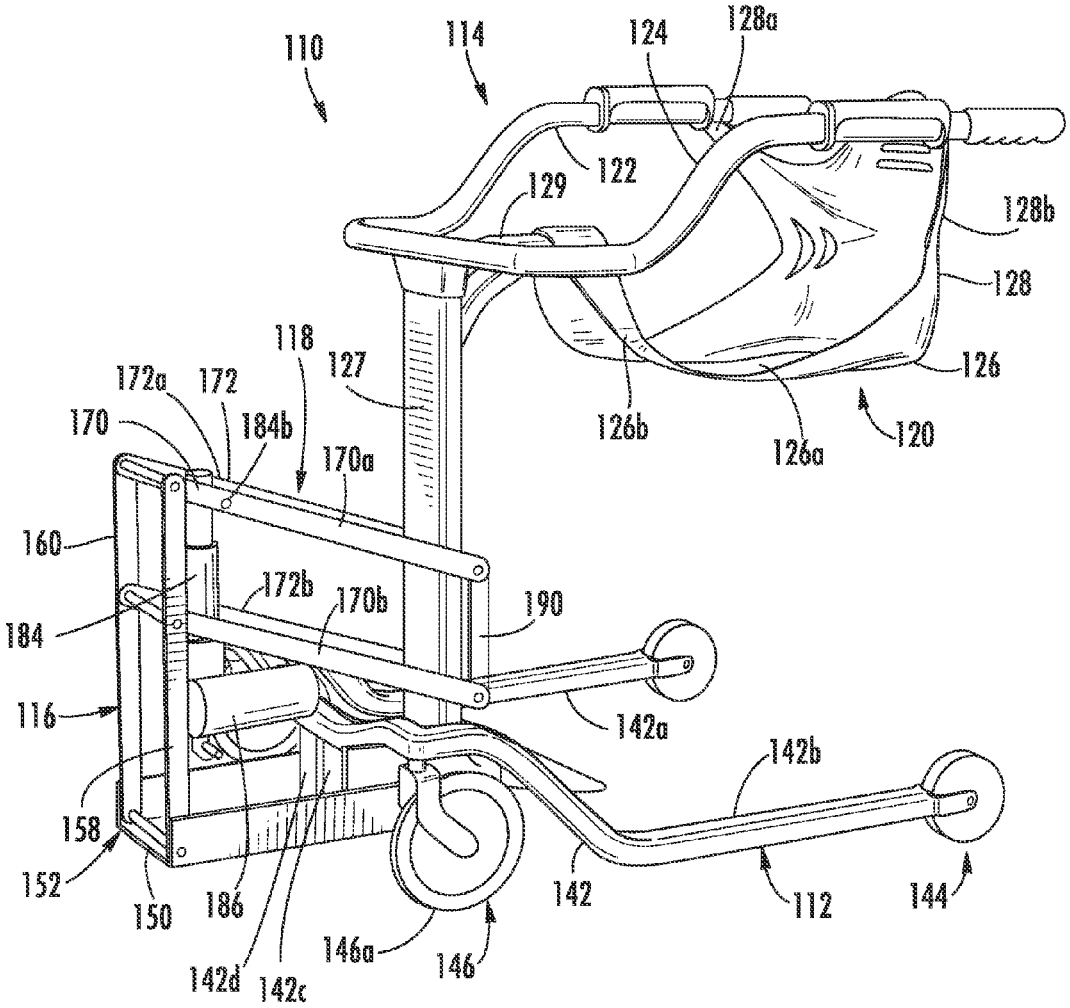
FIG. 8 is a perspective view of another embodiment of a transport apparatus of the present invention.
Figure 8A:
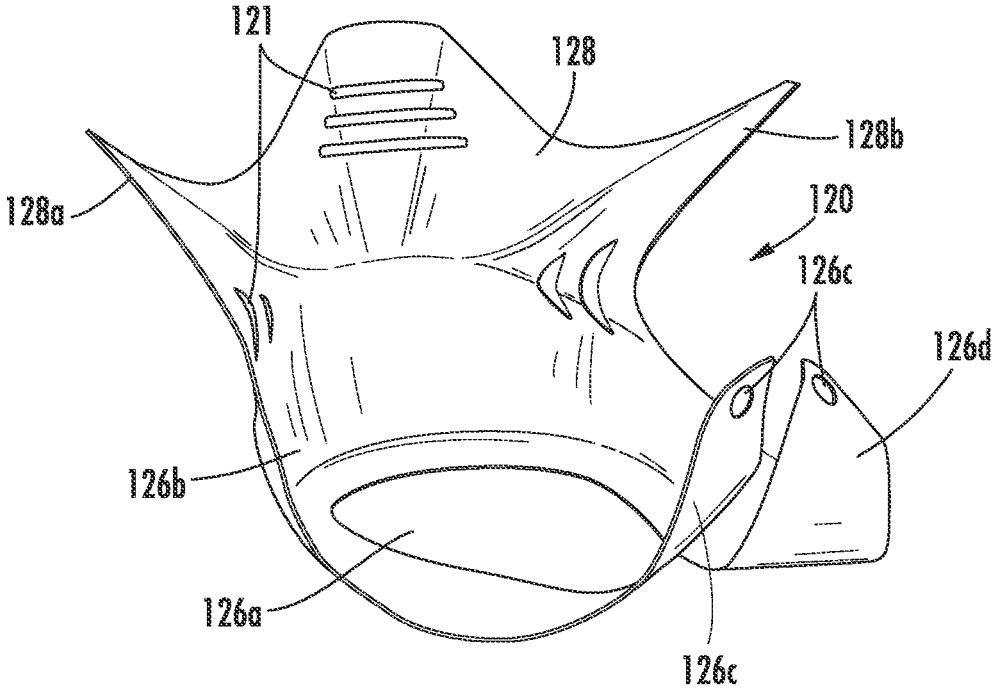
FIG. 8A is a perspective view of the sling of FIG. 8.

Referring to FIG. 8A, as noted above, sling 120 includes a seat portion 126 and a back portion 128. Seat portion 126 comprises a generally U-shaped panel 126*b*, which forms opening 126*a* and, further, which includes upwardly extending arms or extensions 126*c*, 126*d*. Arms 126*c* and 126*d* include openings 126*e* to allow the sling to be coupled to frame 114, described more fully below. Similarly, back portion 128 includes upwardly extending extensions 128*a* and 128*b*, which allow the back portion 128 of sling 120 to be mounted to frame 114 to thereby maintain the back portion 128 in a generally upright orientation when a person is seated in sling 120 and suspend seat portion 126 in frame 114.

Further, sling 120 may include a plurality of openings to promote air circulation and thereby promote comfort for the person. Sling 120 may be formed from a flexible material, such as a fabric, including a gas permeable fabric to provide enhanced air circulation to the person. For example, a suitable fabric may include Gortex or the like.

Figure 8B:
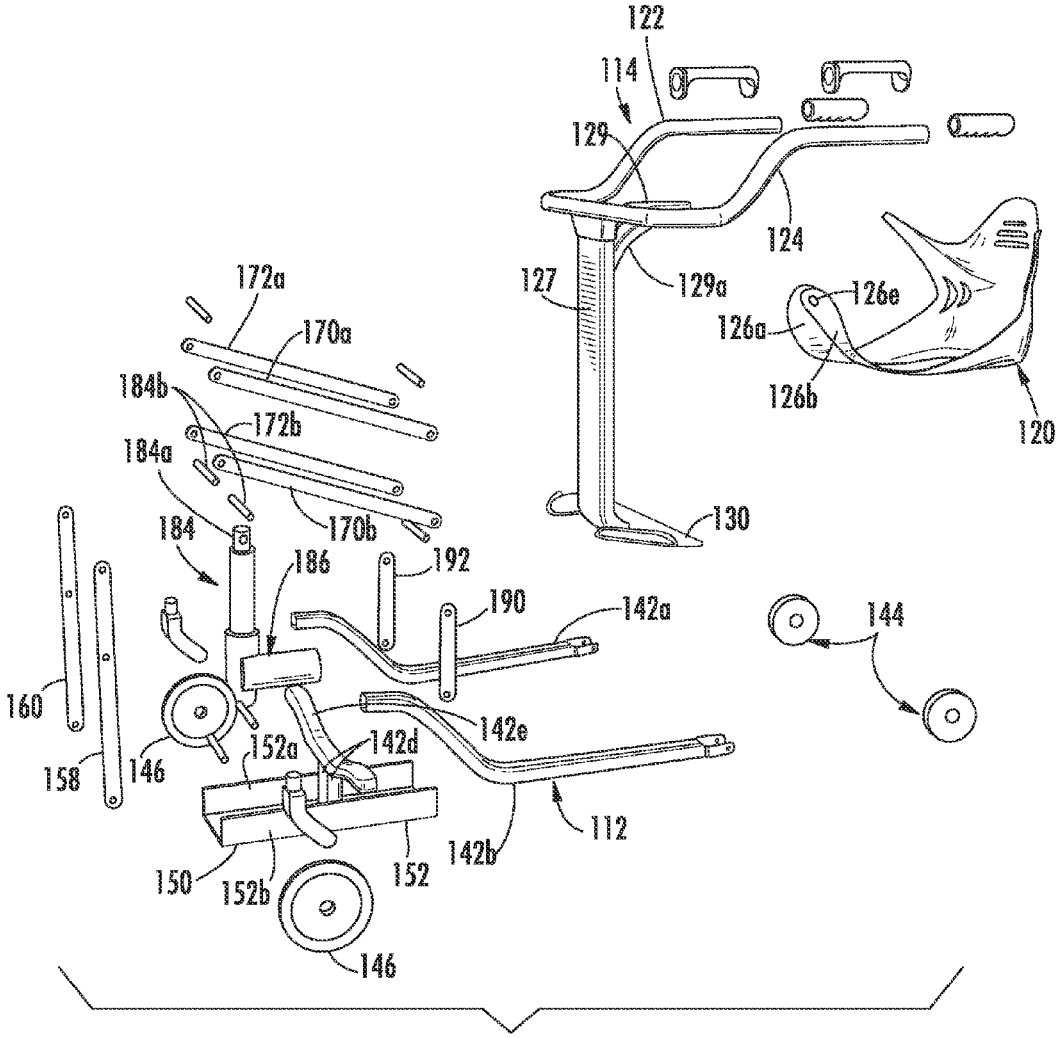
FIG. 8B is an exploded perspective view of the transport apparatus of the FIG. 8.

Referring to FIGS. 8 and 8B, frame 114 is a generally U-shaped frame with a pair of spaced apart arms 122 and 124, which is mounted to a central support member 127. Extending inwardly between arms 122 and 124 is a mounting member 129, which is reinforced by a web or gusset 129*a* welded or otherwise connect to support 127. Mounting member 129 provides a mounting surface for the forward extensions 126*a* and 126*b* of seat portion 126 and, further, is sized to extend in the respective openings 126*e* formed in the extensions of sling 120. For example, member 129 may include a shoulder, which engages the extensions 126*a* and 126*b* once the extensions are slipped onto mounting member 129 and passed over shoulder 128*a*. Snap couplers also may be used to secure the sling to member 129. Extensions 128*a* and 128*b* on the other hand are secured to arms 122 and 124, for example by hooks or couplers, which, as noted above, suspends seat portion 126 in frame 114 between arms 122 and 124. In this manner, similar to sling 20, when a person is seated on sling 120, the person faces upright support 127 and, further, laterally stabilized by the reaction forces due to the weight of the person in sling 120.

Further, mounted to the distal end of vertical support member 127 is an optional footrest 130, such as a plate which allows a user to support their legs and possibly lessen the pressure on the user's thighs.

Referring again to FIG. 8, vertical support member 127 is mounted to linkage assembly 118 between a pair of four bar linkages 170 and 172, which are pivotally mounted at their proximal end to vertical support 116 and at their distal ends to support 127. Each four bar linkage assembly includes an upper and lower linkage 170*a* and 170*b*, 172*a* and 172*b*, which are pivotally connected at their respective distal ends to a pair of vertical linkages 190 and 192 and pivotally mounted their proximal ends to upstanding support 116, which is in the illustrated embodiment is in the form of a pair of elongated vertically oriented spaced members 158 and 160. Support members 158 and 160 are in turn mounted to base 112, more fully described below. To raise and lower frame 114, apparatus 110 also includes a driver 184, for example a linear actuator with an output 184*a* in the form of an extendable member 184, and which is optionally powered by an onboard power supply, such as a battery, including a rechargeable battery.

Figure 11:
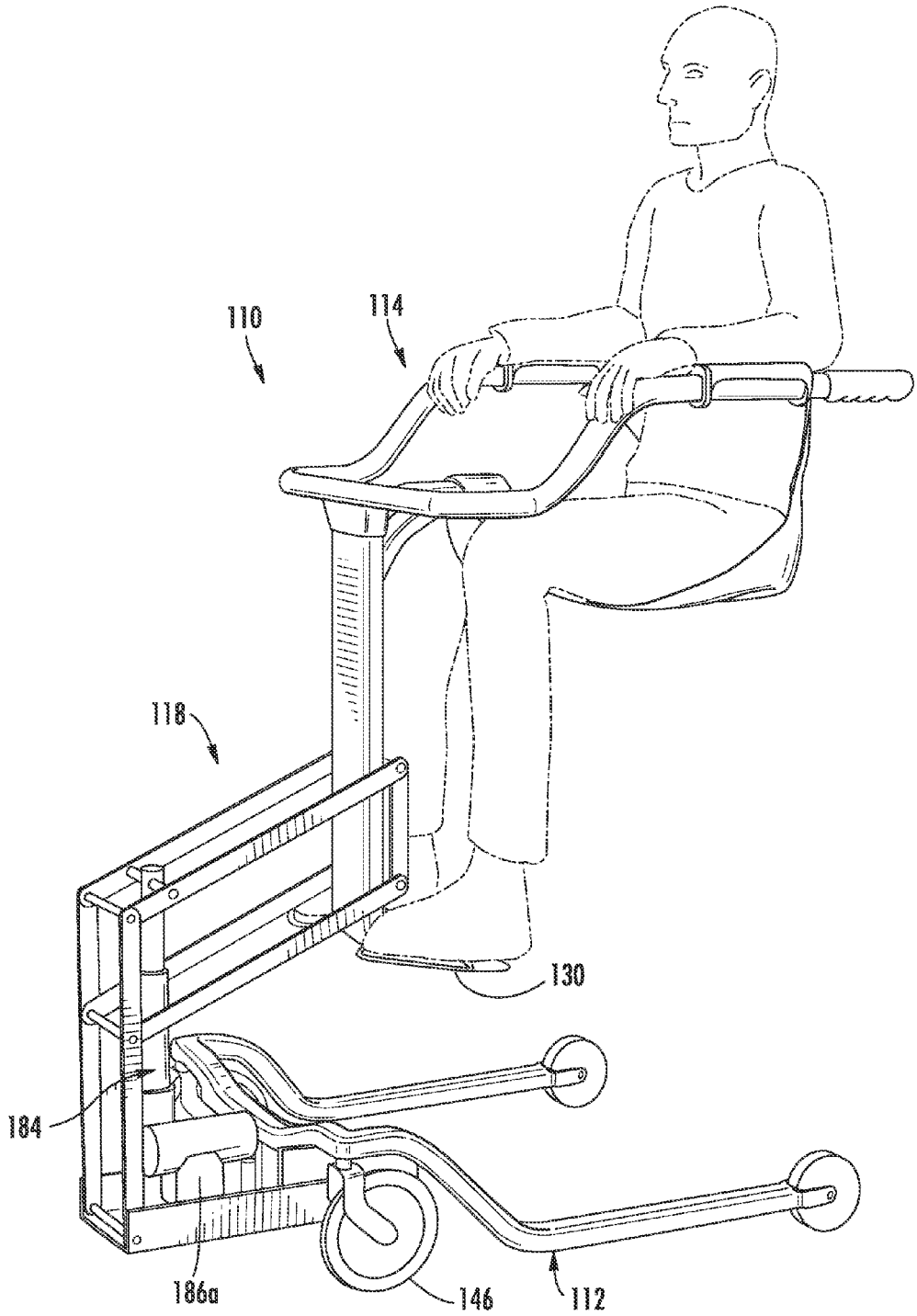
FIG. 11 is a similar view to FIG. 10 illustrating the transport apparatus holding a person.

Again as best understood from FIGS. 8 and 8B, base 112 includes a generally U-shaped frame 142, with two spaced apart side members 142*a* and 142*b* and an interconnecting transverse member 142*c* and a mounting plate 150, which in the illustrated embodiment is provided by an inverted channel-shaped member 152. Vertical members 158 and 160 are secured to the upstanding flanges 152*a* and 152*b* of channel 152 forward of frame 114 so that frame 142 is outside and forward of the footprint of the bearings to balance the loads and moments imposed on base 112. Further, support 116 is mounted to the end of member 152 so that driver 184 may be located between frame 114 and support 116 and further mounted to frame 114 by a bracket 186*a* (FIG. 11). Frame 114 supports channel member 152 with a pair of vertical struts or stanchions 142*d* that support plate 150 below frame member 142. As noted, driver 184 is supported by channel member 152, with its driver output 184*a* coupled to the upper linkages 170*a* and 172*a* of four bar linkages 170 and 172 by a pair of pins 184*b*. Pins 184*b* mount to upper linkages 170*a* and 172*a* between their respective pivotal mounts to support 116 and to vertical support 127. In this manner, when driver output 184*a* is extended, four bar linkages 170 and 172 will pivot about their proximal ends about vertical support 116 to thereby raise or lower frame 114 relative to base 112.

Similar to base 12, base 112 also includes a pair of rearward bearings 144 and forward bearings 146 in the form of wheels, with wheels 146*a* rotatably mounted about a vertical axis to frame 112 to provide steering.

Figure 9:
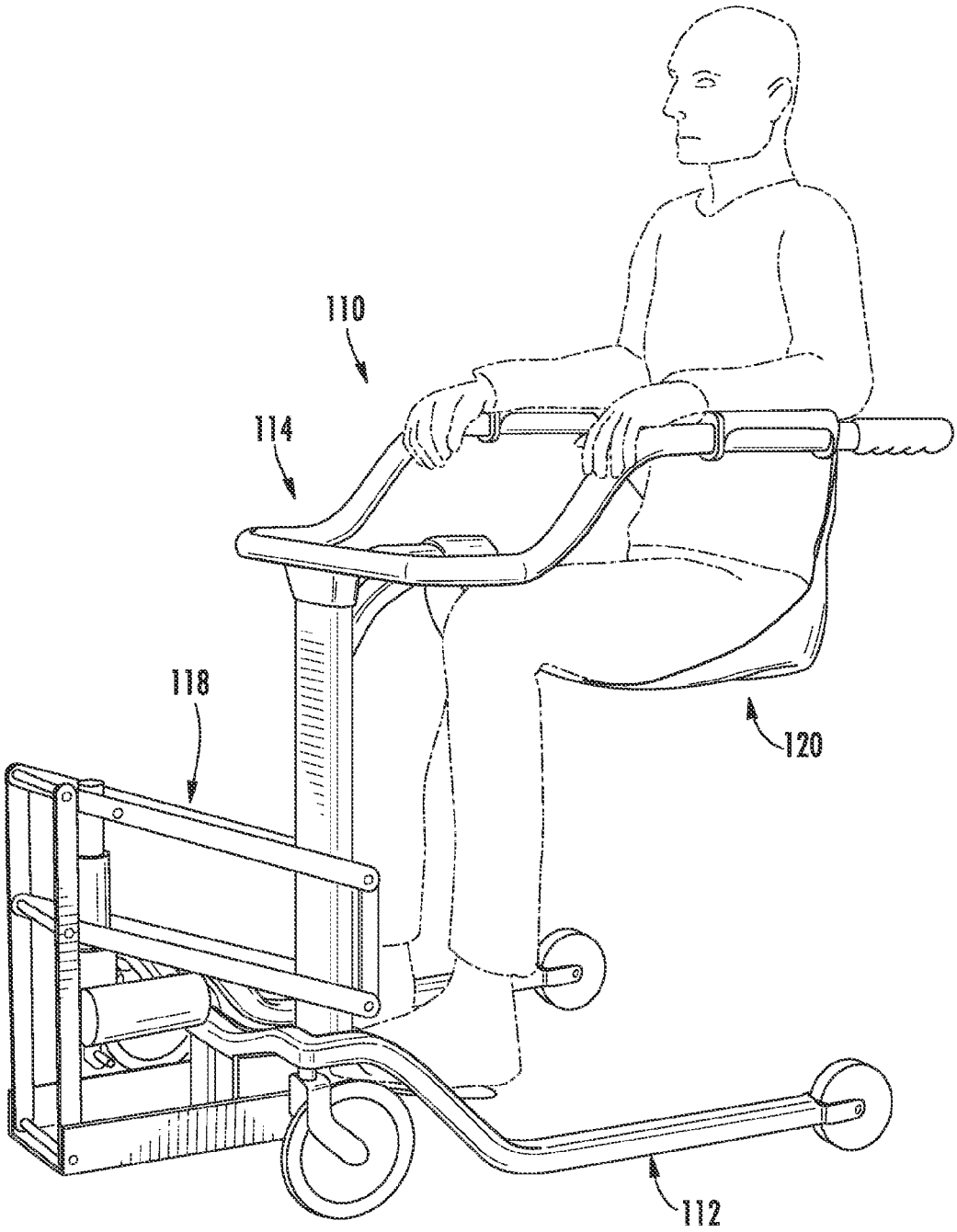
FIG. 9 is a perspective of the transport apparatus of FIG. 8 illustrating the transport apparatus supporting a person.
Figure 10:
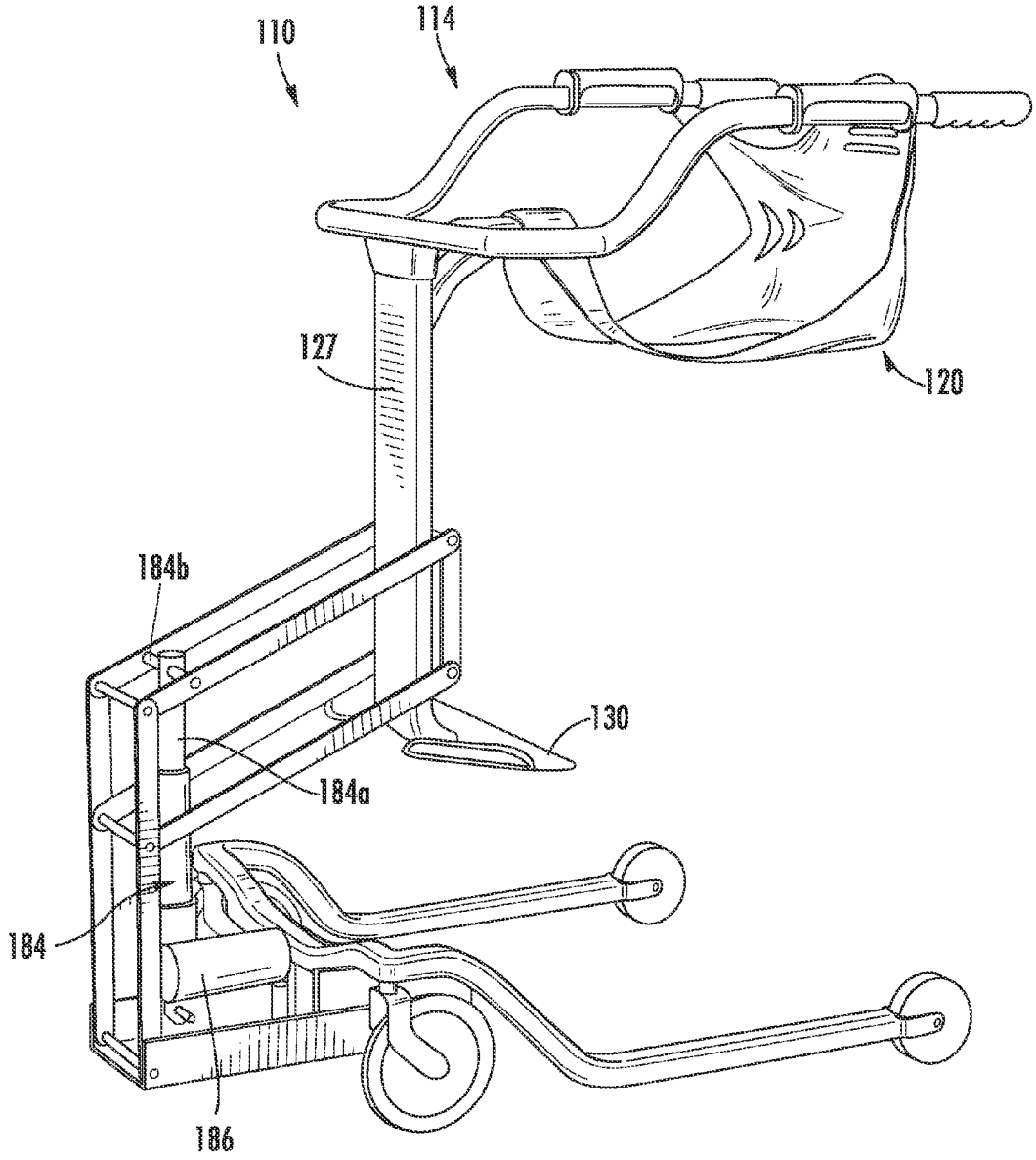
FIG. 10 is a similar view to FIG. 8 illustrating the frame and the sling in a raised position.
Figure 12:
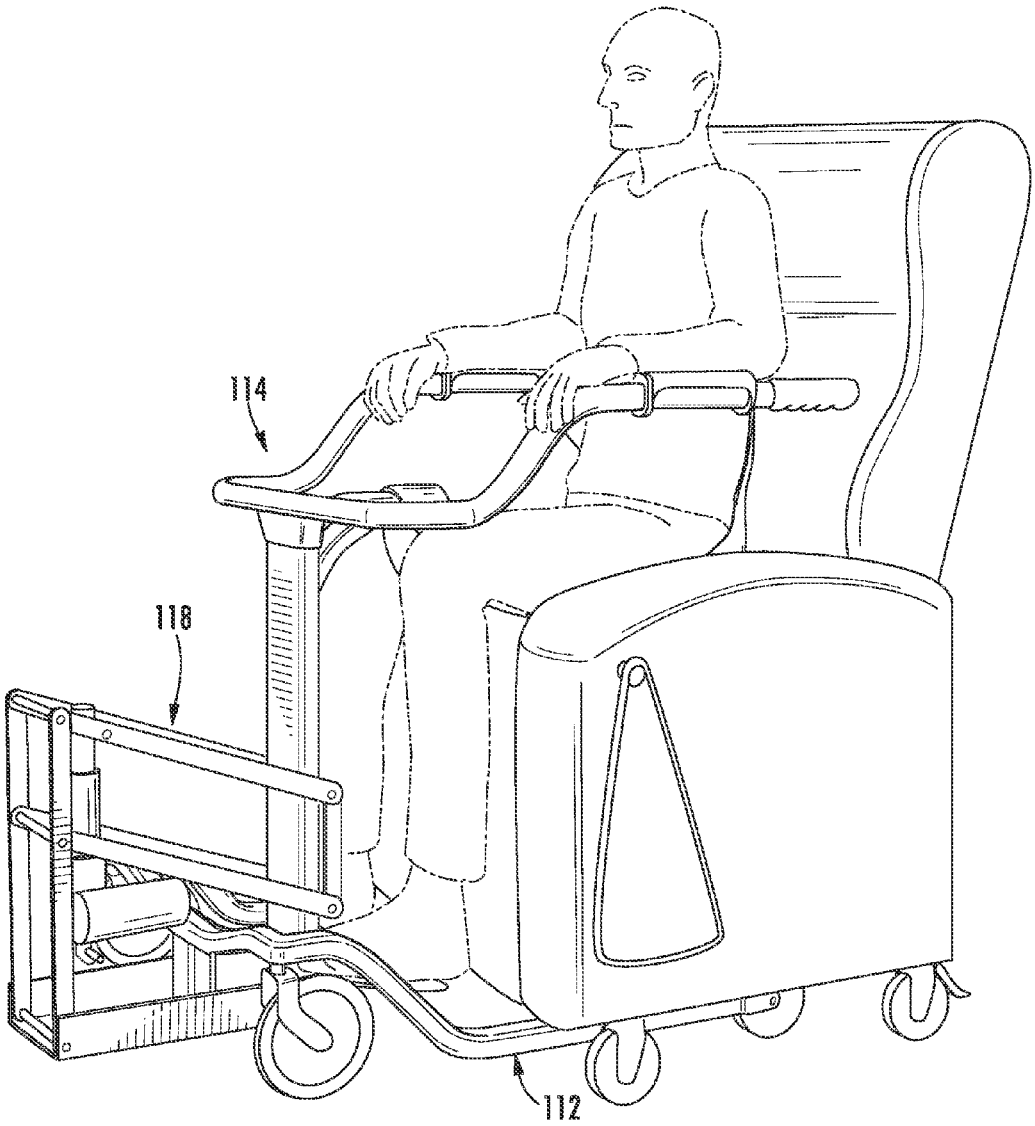
FIG. 12 illustrates the transport apparatus depositing a person on or retrieving a person from a support surface such as a chair.

Referring to FIGS. 9-11, when driver 184 is actuated, the driver moves frame 114 between a lower position, such as shown in FIG. 9, and a raised position, such as shown in FIGS. 10 and 11 to allow a person supported in sling 120 to be aligned over a support surface, such as the chair illustrated in FIG. 12 and once aligned over the surface to be lowered and deposited on the support surface. Once the person is lowered onto the support surface, the sling 120 may be disconnected from frame 114.

Figure 13:
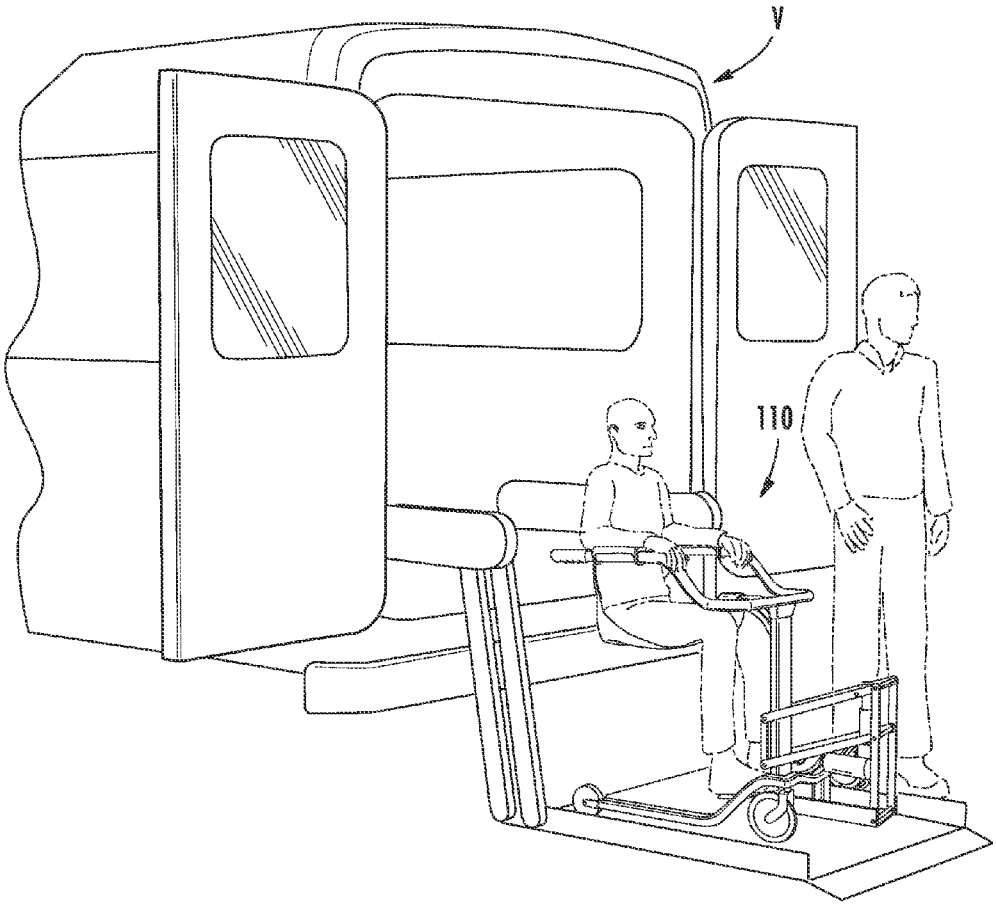
FIG. 13 is a perspective view illustrating the transport apparatus being used to transport a person into or out of a vehicle.

Referring to FIG. 13, apparatus 110 may also be used to transport a person and transfer a person onto a vehicle V, for example, using a lift commonly employed in handicapped vehicles.

Figure 14:
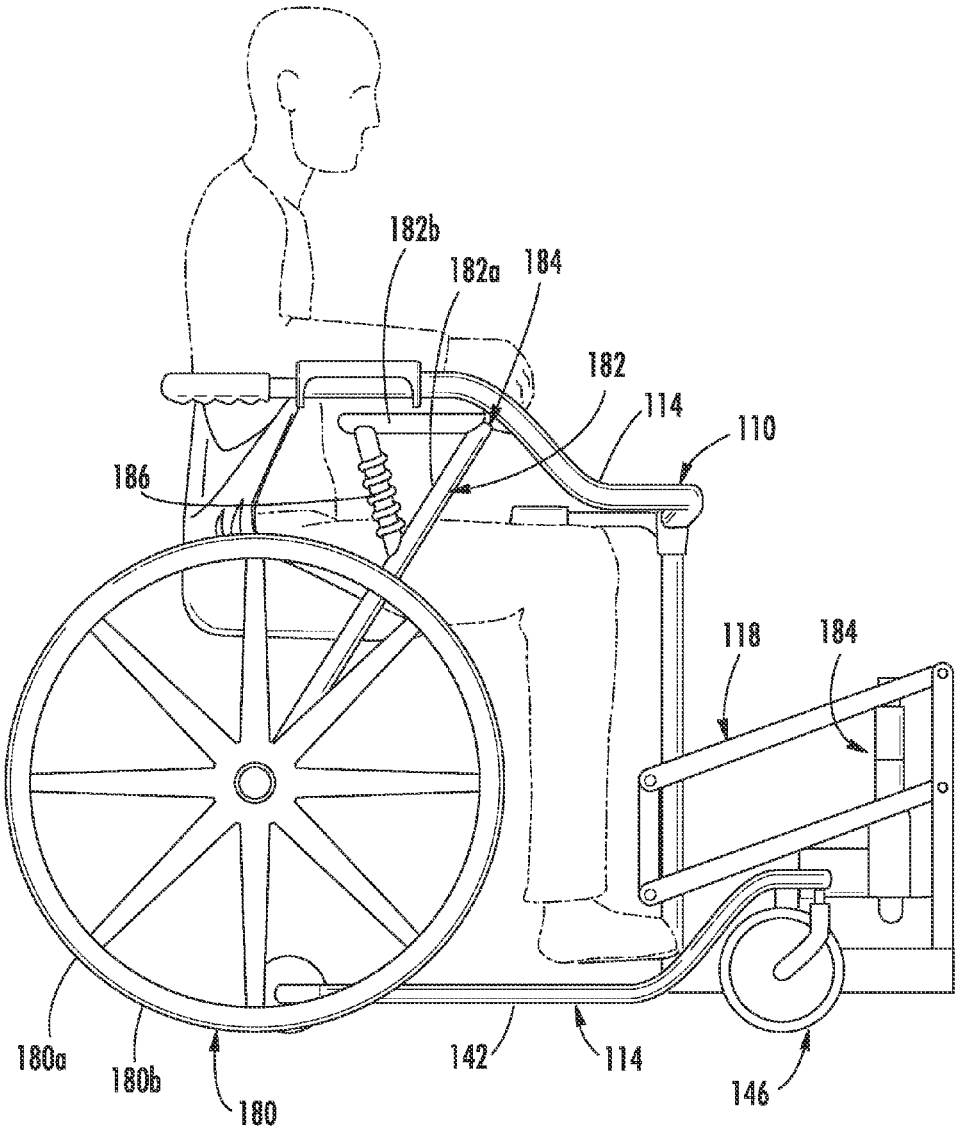
FIG. 14 is a side elevation view of the transport apparatus of FIGS. 8-13 provided with an additional wheel to allow a person supported by the transport apparatus to manually move the transport apparatus.
Figure 15:
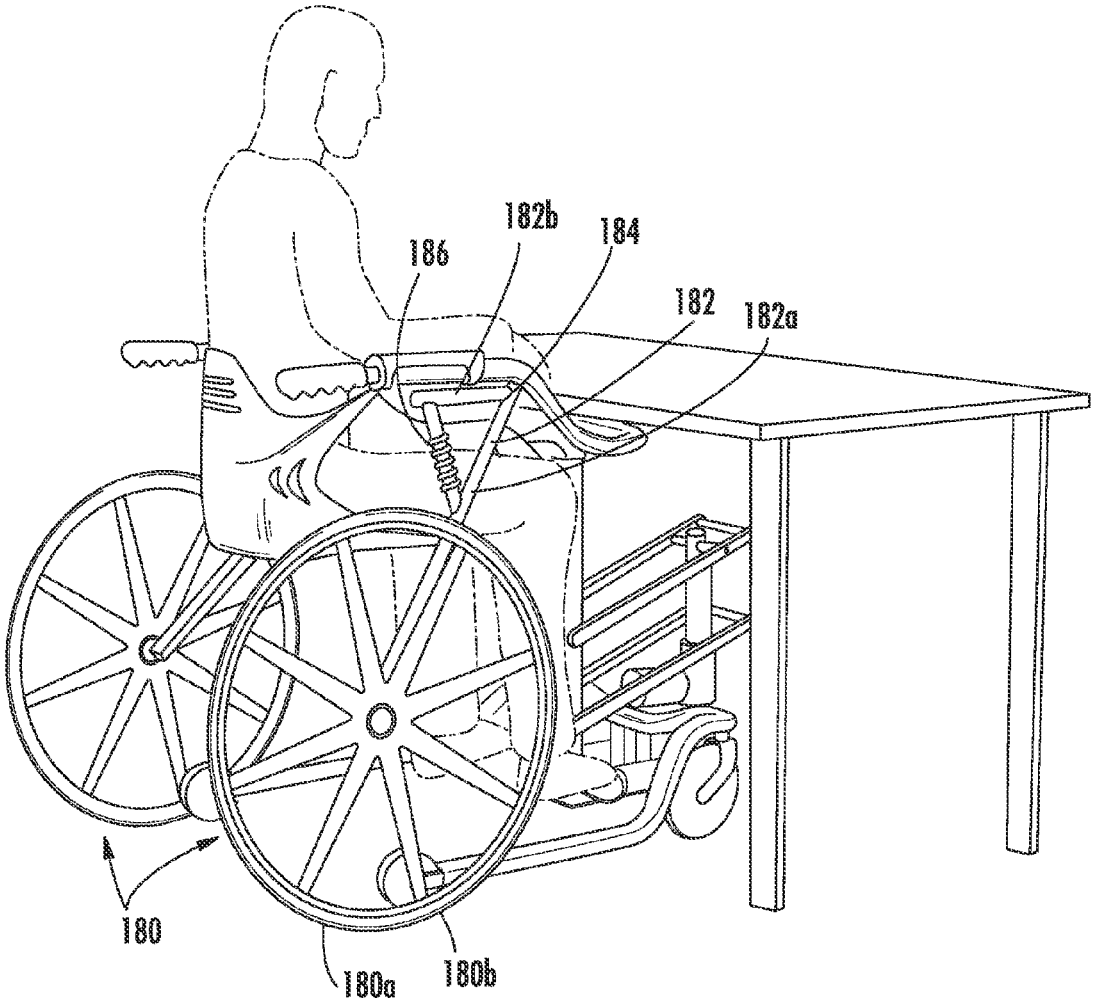
FIG. 15 illustrates the transport apparatus of FIG. 14 with a sling positioned in a height suitable for use adjacent a work at a work surface, such as a table.

Referring to FIGS. 14 and 15, transport apparatus 110 may further incorporate a third pair of wheels 180, which may be mounted to frame 114 to allow a user to engage the wheels for driving apparatus 110. Further, wheels 180 may include an outer pneumatic tire 180*a* and an inner wheel 180*b*, which the user can grasp to drive the wheels hence device 110. In order to prevent wheels 180 from interfering with positioning of apparatus 110 adjacent a support surface, wheels 180 may be pivotally mounted to frame 114 so that wheels 180 may be moved between a stored position, such as shown in FIG. 16A-16C, and a deployed position, such as shown in FIG. 16D, and thereafter moved into a ground engaging position such as shown in FIG. 16E.

Figure 16A:
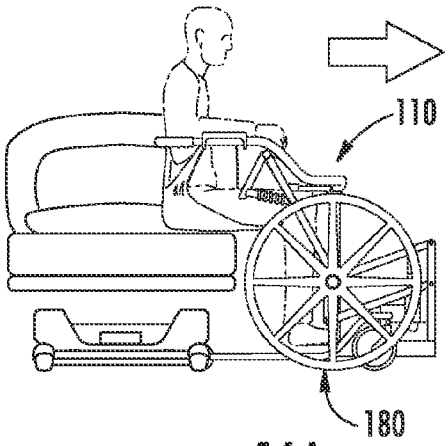
FIG. 16A-16E illustrate one use of a transport apparatus of the present invention for lifting a person from a support surface in the form of a bed and illustrates the drive wheels of FIGS. 14 and 15 moved from a stowed position when the person is being lifted and transferred from the bed to an operative ground engaging position when the sling is lowered.
Figure 16B:
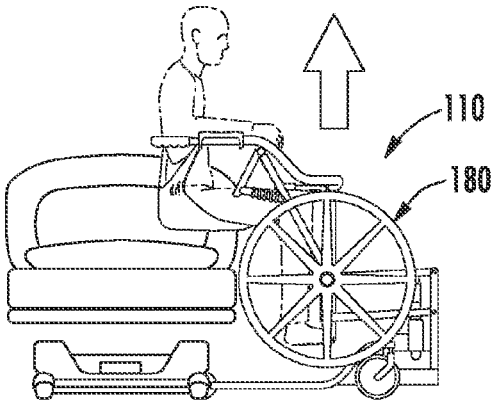
Figure 16C:
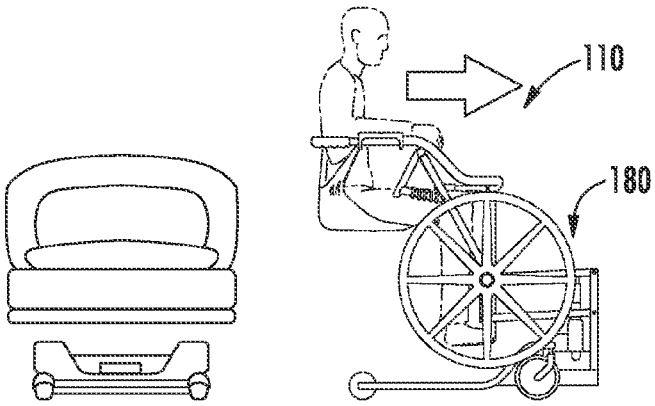
Figure 16D:
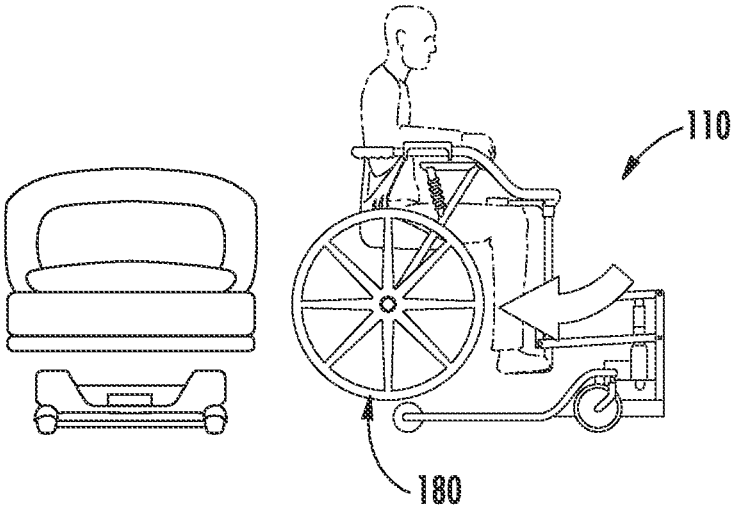
Figure 16E:
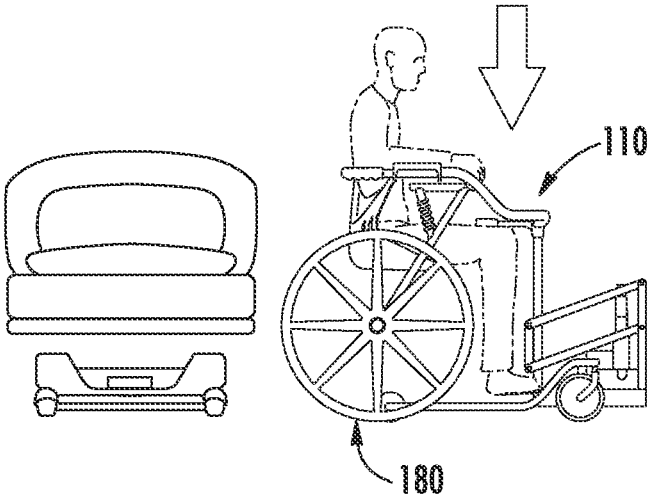

Referring again to FIGS. 14 and 15, wheels 180 may be rotatably mounted to a respective pair of arms 182, which are pivotally mounted to frame 114 by a pivot connection 184, which may for example incorporate a detent mechanism to releasably secure the arm in one of two positions—namely, the stowed position, such as shown in FIGS. 16A-16C, and the deployed position, shown in FIG. 16D and also in FIG. 16E. In the illustrated embodiment, arm 182 includes an angled arm portion 182*a*, which extends from frame 114 from its proximal end to the center of wheel 180 at its distal end, and which supports a bushing for mounting wheel 180 to the distal end of arm portion 182*a*. Arm 182 includes a second arm portion 182*b*, which is angled with respect to arm portion 182 and supports a spring or strut 186 to provide shock absorption and thereby provide a more comfortable ride for the user.

Figure 15B:
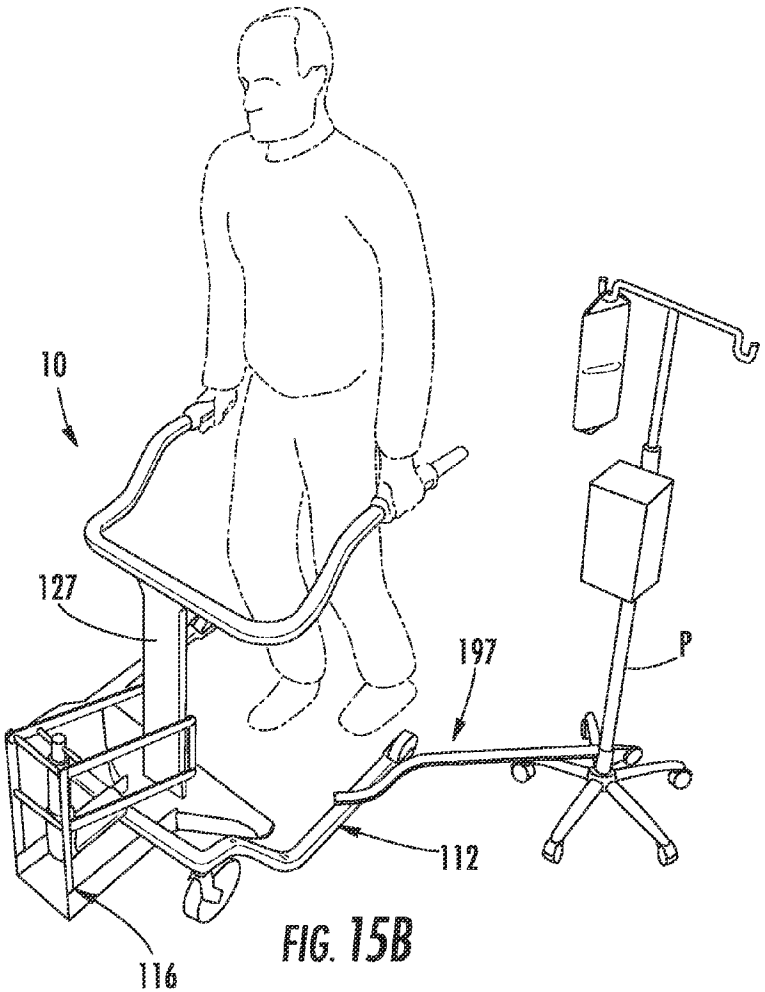
FIGS. 15A and 15B are perspective views of the transport apparatus used as a walker.
Figure 15A:
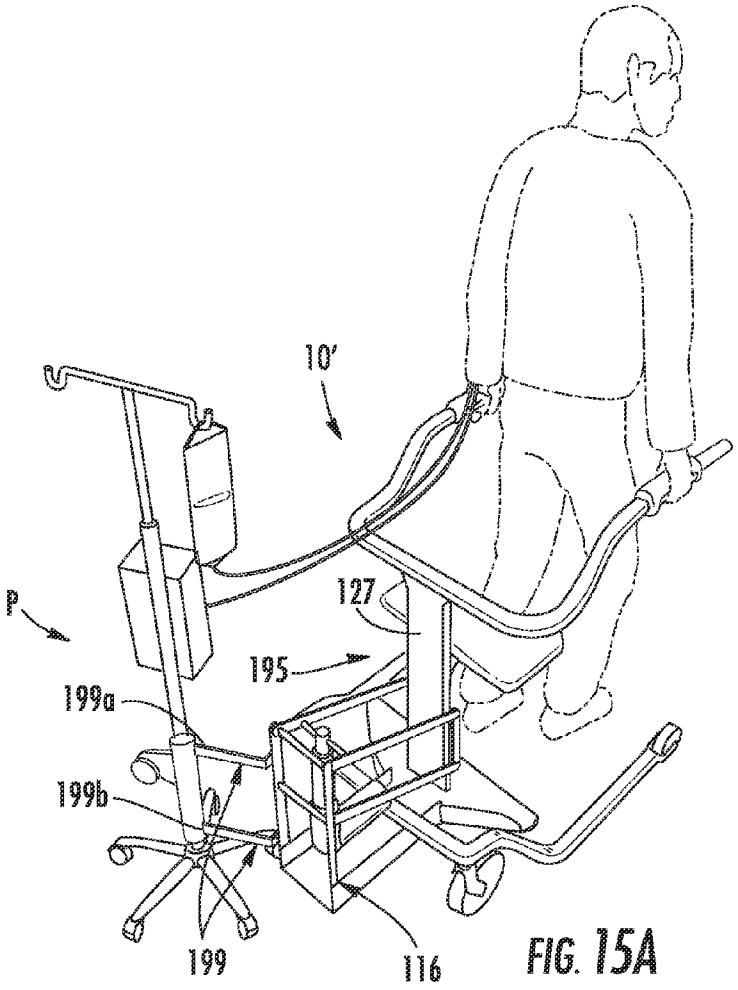

Also, as best seen in FIG. 15A, apparatus 110 may also be used as a walker. For example, when frame 114 is raised so that the handles are at a height suitable for engagement by a person who is standing, the person may stand between the handles facing upright support 116 and vertical support member 127, with the sling either positioned behind the person to provide a seat for resting on, for example, when being used during rehabilitation, or the sling may be removed. Thus, the person standing in apparatus 110 may be sufficiently stabilized by holding onto the handles so that the person may push apparatus 110 to thereby use apparatus 110 as a walker.

The person may also use apparatus 110 as a walker facing away from upright support 116 FIG. 15B). For example, the person may stand between the handles facing away from upright support 16, and the sling may be used to provide additional stability or it may be removed. In this embodiment, a seat 95 may be mounted to vertical support member 127, which is positioned so that it is approximately knee height so that if a person using apparatus 110 as a walker should tire, the person may sit down on the seat.

Further as noted above and as best seen in FIGS. 15A and 15B, an IV pole mount or an IV pole may be coupled to the upright support or base so that an IV pole may be supported or mounted to the base or just coupled to the base. For example, base 112 may include a hitch 197, for example an arm that is pivotally connected to base 112 on one end and coupled to a IV pole P on the other end, for coupling the IV pole to the apparatus. For example, the hitch may be coupled using a ball and socket joint or fasteners, including releasable fasteners, such as clamps or bolts. In some instances it may be preferred to simply couple a wheeled IV pole to the apparatus rather than transfer a portion of the IV pole, and it's associated equipment, such as an infusion pump, to the IV mount on the apparatus. Referring to FIG. 15B, a hitch 199 may be provided that couples the IV pole to the upright support 116. In the illustrated embodiment, hitch 199 includes upper and lower arms 199*a* and 199*b*, which respectively mount (e.g. using ball and socket joints or fasteners, including releasable fasteners, such as bolts or clamps) to upright support 116 at vertically spaced positions to provide enhanced stability for the pole when being pulled by apparatus 110.

As best seen in FIGS. 16A and 16B, when apparatus 110 is moved so that the sling extends over a support surface, wheels 180 are moved to their stowed position so that they do not interfere with the positioning of apparatus 110 adjacent the support surface. After the sling is positioned on the support surface and the patient is positioned in the sling (FIG. 16A) and the sling is raised off the support surface, the apparatus can then be moved away from the support surface (FIG. 16C). Once moved away, wheels 180 may then be moved to their respective deployed positions (FIG. 16D). Thereafter, the sling may be lowered to its lowered position so that the wheels 180 are moved into a ground engagement position, such as shown in FIG. 16E, so that the user can move apparatus 10.

Figure 17:
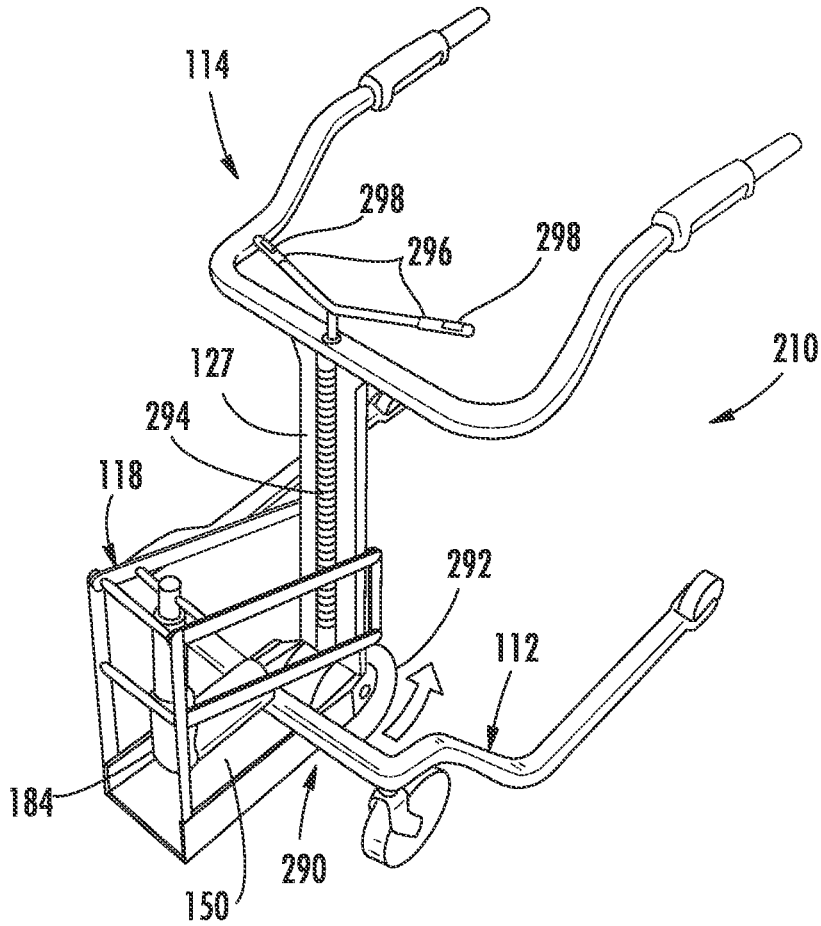
FIG. 17 is a perspective view of a powered version of the transport apparatus.

Referring to FIG. 17, transport apparatus 210, which is of similar construction to transport apparatus 110, incorporates a drive mechanism 290 for driving transport apparatus 210 across a surface. In the illustrated embodiment, driver 290 comprises a powered hub motor wheel 292, which is mounted to frame 112 about a shaft. For example, motor wheel 292 may be mounted by shaft rearward of plate 150 and, further, by a shaft which is rotatably mounted to frame 114 to provide steering. In addition to wheel 292, apparatus 210 may further include a handle 294 such as a T-shaped handle which is mounted to vertical support 127 or frame 114 and which supports a yoke which may support the shaft of wheel 292 to rotatably mount wheel 292 to frame 114. Thus, rotation of handle 294 about its vertical axis will allow a user to steer wheel 292.

Handle 294 may also include a pair of handle grips 296, which allow the user to rotate handle 294 about its vertical axis, and, further, optionally, provide a location mounting for controls 298, which are in communication with the motor of wheel 292 and allow a user to actuate or deactivate the motor of powered hub motor wheel 292. Optionally, powered motor hub wheel 292 may be rotatably mounted by the yoke between and to four bar linkage assembly 118 so that when frame 114 is raised, the drive wheel would be disengaged from the ground. Similarly, when frame 114 is lowered by actuator 184, wheel 292 will be positioned for engagement with the ground to allow a user to drive apparatus 210.

Figure 18:
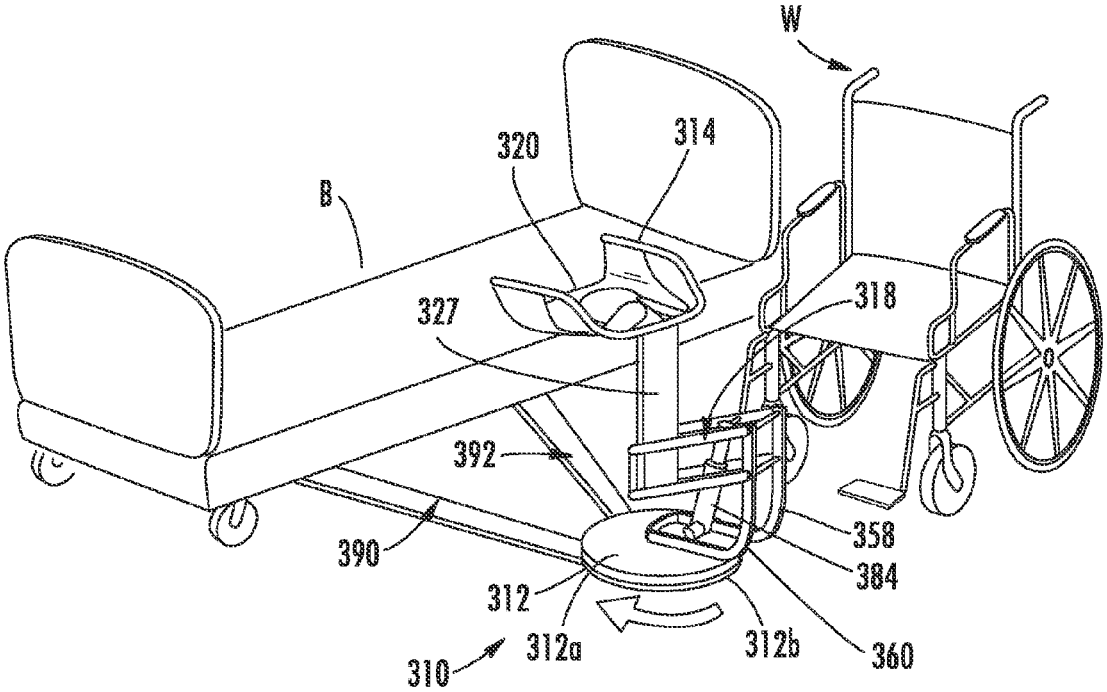
FIG. 18 is a perspective view of the transport apparatus mounted to or built into a bed.

Referring to FIG. 18A, another embodiment 310 of the transport apparatus of the present invention is illustrated. Transport apparatus 310 includes a base 312 and a movable frame 314 to which a sling 320 is removably mounted in a similar manner to sling 120 of apparatus 110. Frame 314 is similarly mounted to a vertical support 327, which is pivotally coupled to a four bar linkage assembly 318, which raises and lowers frame 314 in response to a driver 384 extending or contracting. For further details of linkage assembly 318, frame 314, sling 320, vertical support 327, and driver 384 reference is made to the previous embodiment.

In the illustrated embodiment, four bar linkage assembly 318 is pivotally mounted to a pair of vertical extending arms similar to the previous embodiment, but which form a generally U-shaped mounting portion that is mounted to base 312. Base 312 includes a rotatable upper portion 312*a* and fixed lower portion 312*b*, which is fixed relative to bed B, to allow frame 314 to be rotated and thereby transfer a person supported on a sling 320 from bed B to another support surface, such as a wheelchair W.

In the illustrated embodiment, fixed base portion 312*b* is mounted to bed B by a mounting structure 390, which allows base 312 to be rotated under bed B. For example, a suitable mounting structure may include a pair of cantilevered arms 392, which are pivotably mounted to bed B below the mattress and the deck that supports the mattress, which allows apparatus 310 to rotate under bed B after being folded. In order to fold apparatus 310 so that it can be stored under bed B, apparatus 310 includes a plurality of pivot connections with detent mechanisms.

Figure 19:
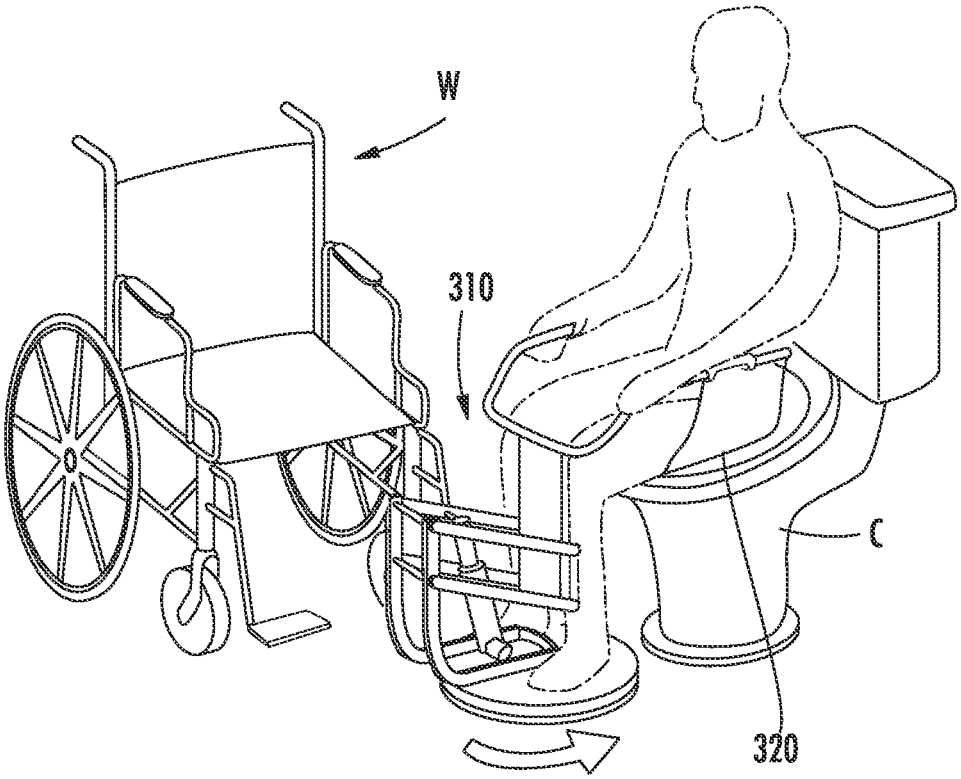
FIG. 19 is a perspective schematic drawing of a transport apparatus of the present invention mounted to a floor to facilitate repeated transfers, for example, to a commode.

Referring to FIG. 19, transport apparatus 310 may be mounted to a floor. For example, lower fixed base portion 312*b* may be mounted to a floor adjacent, for example, a commode so that apparatus 310 may be used to transfer a person from a support surface such as wheelchair W to commode C. As previously noted, sling 320 may be configured to have a central opening to allow a person to use the commode without removing the sling. Ideally, sling 320 is therefore a disposable sling to avoid infection and contamination.

Figure 20:
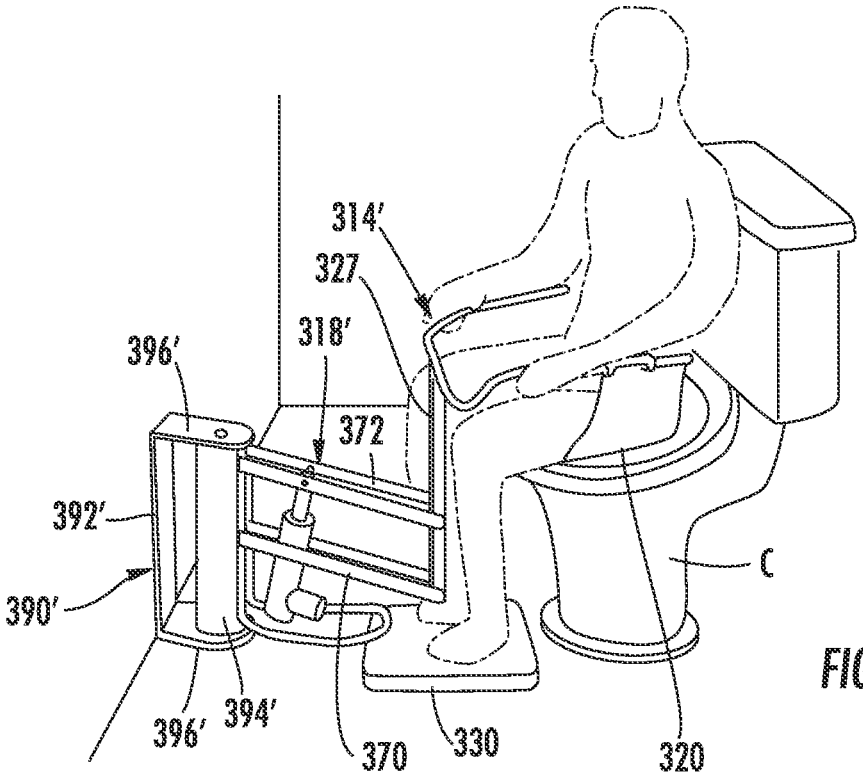
FIG. 20 is a schematic drawing of another embodiment of a transport apparatus of the present invention mounted to a wall.

Referring to FIG. 20, transport apparatus 310', which is of similar construction to transport apparatus 310, 210 and 110 but is modified to mount to a fixed vertical surface, such as a wall. Apparatus 310' includes a frame 314, which supports sling 320 and is mounted to a linkage assembly 318. Four bar linkages 370 and 372 are pivotally mounted at their distal end to vertical support 327 of frame 314 and pivotally mounted at their proximal ends at a mounting assembly 390' for mounting apparatus 310' to a wall. Mounting assembly 390' includes a bracket 392' for mounting to a wall and a rotatable post 394', which is rotatably mounted between the upper and lower flanges 396' of bracket 392'. The proximal ends of linkage assembly 318 are then pivotally mounted to post 394' so that apparatus 310' may be rotated about the rotational axis of post 394' to allow a person to be transferred from, for example, a support surface, such as a wheelchair, to another support surface, such as a commode C. In the illustrated embodiment, driver 384, which raises and lowers linkage assembly 318, may be mounted to an extension of foot rest 330 or may be mounted to bracket 392', for example to its lower flange 396'.

Figure 21:
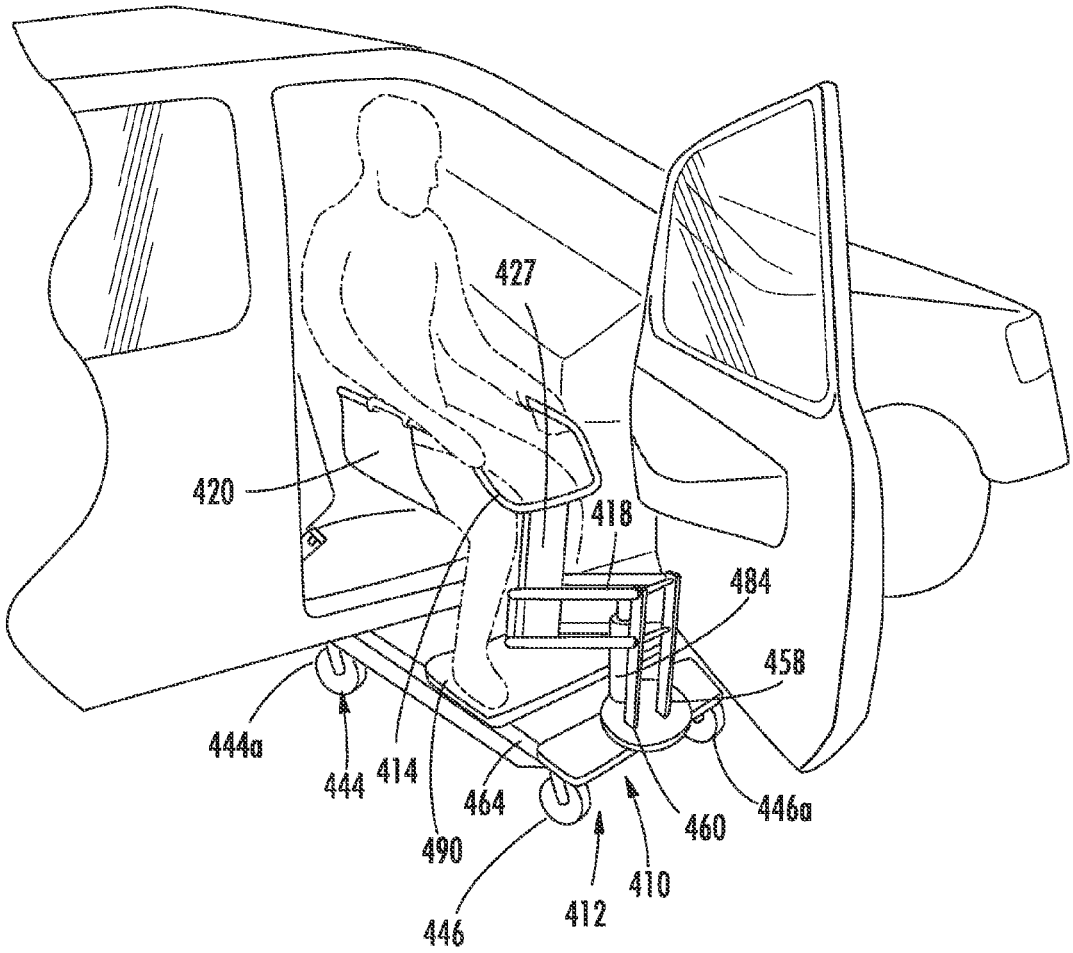
FIG. 21 is a perspective view of another embodiment of a transport apparatus of the present invention for transferring a person in and out of a vehicle.

Referring to FIG. 21, transport apparatus 410 is configured to facilitate the transfer of a person into and out of a vehicle. Similar to apparatus 110, 210, and 310, apparatus 410 includes a based 412 and a frame 414, which supports a sling 420 and is supported for vertical movement relative to base 412. In the illustrated embodiment, frame 414 provides a sufficient range of motion to allow a person to be deposited on or retrieved from a vehicle's passenger or driver seat.

Frame 414 is mounted to base 412 by a vertical support 427 and a linkage assembly 418, which is similar to the linkage assembly described in reference to the previous embodiments. In the illustrated embodiment, linkage assembly 418 is pivotally mounted to a pair of upstanding vertical supports 458 and 460 that are mounted to a base plate 462, which in turn is mounted to a frame 464, which is supported a plurality of bearings 444 and 446, such as wheels 444*a* and 446*a*. Frame 464 and at least wheels 444*a* are configured so that they can extend under a vehicle body and allow apparatus 410 to position sling 420 over the vehicle seat.

Apparatus 410 similarly includes a driver 484 for pivoting linkage assembly 418 about supports 458 and 460, as noted, at a height sufficient to deposit or retrieve a person from a vehicle seat. Optionally, apparatus 410 may also include a foot rest 490 that it mounted to frame 464. For further details of sling 420, frame 414, support 427, linkage assembly 418, and driver 484, reference is made to the previous embodiments.

In addition, as noted above, any of the transport apparatus of the present invention may be used to support a person while being transported or while driving. Referring to FIG. 13, when transport apparatus 110 is moved into vehicle V, vehicle V may optionally incorporate an anchorage system to thereby anchor apparatus 110 in the vehicle. Furthermore, apparatus 110 may be anchored toward the front of the vehicle and, further, at the driver's side of the vehicle so that the user may also operate the vehicle for example with hand controls.

Accordingly, the transport apparatus of the present invention allow a person to be transferred from one support surface, such as a bed, stretcher, seat, such as chair, car seat, wheelchair or a seat on a commode, to another support surface or may be just simply used to transport the person.

While reference is made herein to the various components as "members," it should be understood that this term is used broadly and may encompass a wide variety of structural members including rods, tubes, angles, plates, for example, and further typically metal structural members, such as aluminum or stainless steel, though it should be understood that other materials may be used. Additionally, each member may be formed from one or more members. Additionally, while several components have been described as separate members, some members may be combined.

While several forms of the invention have been shown and described, other forms will now be apparent to those skilled in the art. For example, while a single powered hub motor wheel is illustrated, it should be understood that multiple powered hub wheels may be provided and, further, may be used to steer the vehicle by selectively and independently powering the wheels. It also should be understood that in any of the embodiments described herein, the footprint of the respective apparatus may be increased or decreased depending on the application. For example, for home use, the transport apparatus may be configured to have a footprint that clears standard doorways. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which an exclusive property right or privilege is claimed are defined as follows:

1. A transport apparatus comprising:

a base;

a sling, said sling forming a seat portion and a back portion, said seat portion being directly connected to said back portion, and said seat portion and said back portion being reconfigurable between an unfolded, generally planar configuration wherein said sling can lie generally flat on a support surface and a folded configuration wherein a person can be supported in a sitting position;

a support frame mounted to said base, said support frame extending over said base and being configured to move from a first position spaced above said base at a first height, said support frame including a pair of arms for engaging said seat portion, wherein when said support frame is extended over and proximate a support surface, said arms are extendible to engage said sling when placed on the support surface; and a plurality of couplers directly connecting said back portion to said support frame when said arms of said support frame are engaged with said seat section and said sling is moved to its folded configuration, and said frame being movable to a second position spaced above a second height greater than said first height once engaged with said sling wherein said sling is raised above the support surface, and said support frame providing lateral support to said seat portion of said sling when engaged with said sling, wherein when said support frame and said sling are raised to said second position said sling is raised above the support surface so that a person supported on said sling may be lifted off the support surface with said sling and said frame supporting the person in a stabilized sitting position so that the person can be moved away from the support surface by said base.

2. The transport apparatus according to claim 1, wherein each of said couplers includes a strap and a buckle, said straps securing said buckles to said frame.

3. The transport apparatus according to claim 1, wherein said seat portion includes a pair of sleeves for receiving said arms.

4. The transport apparatus according to claim 1, wherein said base includes a plurality of bearings.

5. The transport apparatus according to claim 4, wherein said bearings define a footprint, said support frame mounted to said base outside of said foot print.

6. The transport apparatus according to claim 1, further comprising an upstanding support mounted to said base and a four bar linkage mounted at its proximal end to said upstanding support, said support frame mounted to the distal end of said four bar linkage.

7. The transport apparatus according to claim 6, wherein said four bar linkage comprises two four bar linkages, each of the proximal ends of the four bar linkages being pivotally mounted to said upstanding support, and said support frame mounted to the distal ends of said four bar linkages, and said four bar linkages being interconnected by a transverse member, said base supporting a driver engaging said transverse member to pivot said four bar linkages about their proximal ends.

8. The transport apparatus according to claim 1, wherein said support frame is further configured to move to a third position at a third height different than said first height and said second height wherein a person supported on said sling may be deposited on a second support surface at a lower or greater height than the first support surface.

9. A transport apparatus comprising:

a movable base;

a sling, said sling forming a seat portion and a back portion, said seat portion directly connected to said back portion and said seat portion and said back portion reconfigurable between a generally planar configuration wherein said sling can lie generally flat on a support surface and a folded configuration wherein a person can be supported in a sitting position in said sling; and a support frame mounted to said base, said frame being configured to move from a first position spaced above said base at a first height wherein said support frame may be extended over and proximate a support surface to a second position spaced above said base at a second height greater than said first height, said frame being engaged with said seat portion when said frame is in said first position and said sling is in its generally planar configuration, a pair of couplers directly connecting said frame to said back section when said frame is engaged with said seat section and said sling is in said folded configuration wherein said transport apparatus can support and transport a person supported by said sling from one location to another location, and said sling releasably engaged with said frame wherein a person supported by said sling may be deposited with said sling on another support surface when the frame is extended over the other support surface.

10. The transport apparatus according to claim 9, further comprising a driver supported on said base, said driver being operable by a user or a person supported by said transport apparatus, and said driver selectively moving said frame between said first and second positions.

11. The transport apparatus according to claim 9, further comprising an upstanding support mounted to said base and two four bar linkages, each of the proximal ends of the four bar linkages being pivotally mounted to said upstanding support, and said support mounted to the distal ends of said four bar linkages, and said four bar linkages being interconnected by a transverse member, said driver selectively applying a force to said transverse member to pivot said four bar linkages about their proximal ends.

12. The transport apparatus according to claim 9, wherein said seat portion includes a pair of sleeves, said frame having a pair of arms, said arms being extendible into said sleeves to thereby releasably engage said seat portion of said sling.

13. The transport apparatus according to claim 9, wherein said frame is releasably connected to said back portion by said couplers, when connected said couplers retaining said sling in said folded configuration.

14. The transport apparatus according to claim 13, wherein said each of said couplers includes a strap and a buckle, said straps securing said buckles to said frame, and said buckles releasably connecting said frame to said back portion.

15. The transport apparatus according to claim 9, wherein said base includes a plurality of bearings.

* * * * *